US007743636B2

(12) United States Patent
Rusch

(10) Patent No.: US 7,743,636 B2
(45) **Date of Patent: *Jun. 29, 2010**

(54) ROTARY DRAW TUBE BENDER

(76) Inventor: Christopher J. Rusch, 3718 Riverview Dr., Two Rivers, WI (US) 54241

( * ) Notice: Subject to any disclaimer, the term of this patent is extended or adjusted under 35 U.S.C. 154(b) by 146 days.

This patent is subject to a terminal disclaimer.

(21) Appl. No.: 12/080,401

(22) Filed: Apr. 2, 2008

(65) Prior Publication Data

US 2008/0236234 A1 Oct. 2, 2008

Related U.S. Application Data

(63) Continuation of application No. 11/724,852, filed on Mar. 16, 2007, now Pat. No. 7,380,430.

(51) Int. Cl.
*B21D 7/00* (2006.01)
*B21D 7/04* (2006.01)

(52) U.S. Cl. ..... 72/149; 72/158; 72/482.7

(58) Field of Classification Search ..... 72/149–151, 72/155–159, 482.7

See application file for complete search history.

(56) References Cited

U.S. PATENT DOCUMENTS 3,205,690 A * 9/1965 Roessler, Jr. ..... 72/150
5,689,988 A * 11/1997 Schwarze ..... 72/157
2005/0263990 A1* 12/2005 Clute ..... 280/733

OTHER PUBLICATIONS

Various pages of Baileigh Brochure published in May 2005, showing various tube bending machines with conventional die positioning mechanisms and machine controls with foot pedals.

* cited by examiner

*Primary Examiner*—Dana Ross
*Assistant Examiner*—Debra M Sullivan
(74) *Attorney, Agent, or Firm*—Jeffrey S. Sokol

(57) ABSTRACT

The invention is a rotary draw bending machine and process for bending materials such as tubes or pipes into precise bends. A spindle holds a bending die, and a radial arm holds a counter-die. The spindle and arm are simultaneously rotated in opposite directions by a dual hydraulic drive controlled by an electro-hydraulic control system with foot pedal controls. The bend angle is preset by a protractor-like dial and limit switch mechanism. The radial arm has a slide track to align the counter-die with the bending die. The ratchet mechanism has teeth to allow incremental advancement of the counter-die when aligning it with its bending die to accurately set the gap between the dies. The machine is used with a wide variety of dies to bend a wide variety of workpiece diameters. The ratchet mechanism preferably includes a fine tuning device to provide an infinite range of alignment positions.

29 Claims, 16 Drawing Sheets

34
52
10
41
110
115
84
20
31
60
81
62
70
71
91
162
141
120
158
150
154
165
129
131
21
121
27
22
26
27
24a
28
21
23
23a
29a
29
234
236
235
28

ROTARY DRAW TUBE BENDER

CROSS REFERENCE TO RELATED APPLICATION

This application is a Continuation of U.S. application Ser. No. 11/724,852 filed Mar. 16, 2007, now U.S. Pat. No. 7,380, 430.

TECHNICAL FIELD OF THE INVENTION

This invention relates to a rotary draw tube bender with a rotating spindle and arm driven by a dual hydraulic drive via an electro-hydraulic control system with foot pedal controls, and aligned with a ratchet mechanism to incrementally and accurately set the gap between the bending die and counter-die.

BACKGROUND OF THE INVENTION

Many buildings, construction sites, manufacturing plants and machine shops require or use a significant quantity of bent tubes, pipes and rods to produce items such as hand rails, scaffolding, or fabricated metal products. A variety of conventional machines have been developed to facilitate the otherwise difficult task of bending of rigid metal tube or pipe into a desired shape. One type of tube bending machine is the rotary draw bender. This bending machine 5 uses a bending die with a concave groove. The groove is uniform in shape and diameter around the circumference of the die. The bending die has a corresponding counter-die, which combine to form a die set. The forward wall of the counter die has a linear channel that forms a concave groove along its length. This straight groove flushly receives the straight tubular workpiece. The diameter of the groove of the bending die is the same as its corresponding counter die, and both die can have a circular or slightly elliptical shape. The diameter of the grooves of a die set match the outside diameter of the tubular workpiece that they will bend.

A rotary draw tube bending machine 5 with a hydraulic drive is shown in FIG. 1. One drive cylinder rotates a spindle carrying the bending die. The other drive cylinder simultaneously rotates an arm carrying the counter-die. The cylinders extend during a bending cycle, and retract in a return cycle to bring the machine back to its home position shown in FIG. 1. The machine 5 simultaneously distributes pressurized hydraulic fluid to one end of each cylinder during the bending cycle, and to the other end of each cylinder during the return cycle. The pressure delivered to each cylinder is kept equal by mechanical fluid pressure splitting devices 6, and a number of supply, return and pressure balancing hoses 7. Equal pressure in the drive cylinders is important to ensure that both cylinders are extended at the same rate, and are contracted at the same rate.

The bending machine 5 uses a mounting assembly 8 to hold the counter-die. The assembly 8 has two downwardly extending bolts that are received by spaced holes 9 drilled into the top of the rotating arm. The posts are inserted into selected holes 9 to fix the assembly 8 in place, and position the counter-die with the bending die. For example, a hole 9 drilled at a location for a bending die made to form a two inch bend radius into a one inch diameter ASTM schedule 40 pipe, would be about one inch away from another hole 9 drilled for a bending die made to form a three inch bend radius into a one inch diameter schedule 40 pipe. The mounting assembly includes a pivot post and swing assembly to swing the counter-die into and out of engagement with the bending die.

Swinging the counter-die out of engagement allows a straight workpiece 10 to be loaded, or a bent workpiece 15 to be unloaded. The machine 5 also includes a bend angle setting device with a protractor-like dial and a stop switch. The switch automatically deactivates the hydraulic drive when the machine reaches the desired pre-set bend angle.

An unbent workpiece 10 is loaded into the bending machine 5 by placing it in an outer concave groove of the bending die. The outer wall 12 of the workpiece 10 flushly engages the concave groove of the die. The straight workpiece 10 is tangent to the circular bending die. The bending die has a hook that engages the opposite side of the tubular workpiece to secure it to the bending die. The counter die and mounting assembly 8 are picked up and set onto the rotating arm with its posts mating selected holes 9 to set the die gap for the particular die set. The counter-die is then swung into pressing engagement with the workpiece 10 to fix the workpiece to the bending die via its hook. When the bending die is rotated, the tube 10 is drawn by the hook, pulled through the channel of the counter die, and wrapped around the groove of the bending die.

The combined rotation of the bending die and rotating arm determines the bend angle of the tube 15. The shape of the bend 16 is determined by the radius of the bending die, the shapes of the arcuate grooves of both dies, and the gap between the dies during the bending process. The groove of a typical bending die has a semi circle shape. The groove of the counter-die has an engineered shape that is slightly elliptical and slightly less than a semi-circle. The edges of the counter-die do not directly contact the edges of the bending die when they are brought together to hold and substantially surround the workpiece 10. The edges of the dies are spaced apart to form a die gap of about ⅛ inch.

The die gap must be properly set to attain a desired bend shape that is free from irregularities in the bend region 16. The bend region 16 of the tube or pipe 15 should have a continuous bend, a desired uniform radius, and a rounded outer portion 17. The die gap determines the amount of pressure the counter-die exerts on the tube 10 during the bending operation. If the gripping pressure is too high, the tube 10 will bind with the counter-die, and slide through the hook during the bending process. A properly set die gap prevents slipping. Slipping results in the tube sliding through the hook and bending die groove, disengages from the bending die, and forms a kink in the tube. This kinking creates a non-continuous bend with a non-uniform radius, which is visually and dimensionally unacceptable, so that the tube has to be scrapped.

The die gap ensures that the groove surface of the counter-die remains flushly engaged with the outer surface 12 of the tube or pipe 10 when forming the bend. During the bending process, the rounded outer portion 17 of the workpiece 10 should conform to the shape of the counter-die, even when the groove surface is slightly elliptical as shown in FIG. 3. This flush engagement is particularly important toward the working end of the counter-die where the metal flow occurs to form the bend. The flow area 19 is a narrow strip located just inside the trailing end of the counter die. When the die gap is properly set, the counter-die provides enough pressure to maintain the tube 10 in flush engagement with the counter-die in the flow area 19 so that the outer half 17 of bend 16 has a desired rounded shape as shown in FIG. 3. If the die gap is too large and the counter-die pressure is too small, the outer wall 12 of the tube or pipe 10 will pull away from the counter-die groove, which causes the outer half 17 of the bend 16 to flatten out 18 as shown in FIG. 4. Third, the die gap also avoids rubbing between the dies, which can lead to wear and tear on the dies and cause binding problems during the bending process.

Conventional tube bending machines should accommodate various dies and die sets, such as those shown in FIG. 2. A tube or pipe workpiece 10 with a particular diameter requires a particular die set. As noted above, the selected bending die and counter-die should flushly engage the outside wall or surface 12 of a tubular workpiece 10 during the bending process. A smaller diameter workpiece 10 requires a bending die and a counter die with smaller concave groove surfaces. A larger diameter workpiece 10 requires dies with larger concave groove surfaces. A particular desired bend radius requires a particular bending die. A small radius bending die produces a tube 15 with a small radius bend. A large radius bending die produces a tube 15 with a large radius bend. Die sets are changed at a job site when the diameter of the tube or workpiece 10 changes. Bending dies are changed at a job site to change the bend radius being formed into a workpiece 10.

A problem with conventional tube bending machines is that they only form a limited number of bends. The machines are specifically designed and manufactured for use with a limited number of bending dies and die sets, and thus only accommodate certain diameter tubes or pipes 10, and only form specific bend radii in those tubes and pipes. For example, the spaced linear holes 9 in the rotating arm of the rotary draw tube bending machine 5 shown in FIG. 1 only allow proper positioning of a limited number of bending dies and die sets, to form a limited number of bend radii in specific diameter workpieces. The location of each hole 9 for securing the mounting assembly 8 and its counter-die is determined prior to manufacture. Once the counter-die assembly is secured in place via a selected set of holes 9, the counter-die location is fixed. Yet, industries are constantly requiring more and more variations in bend geometry and pipe diameters. Conventional tube benders do not meet the industry need for continuously increasing flexibility in permissible workpiece sizes and bend geometries.

Another problem with conventional tube bending machines is that they do not allow field operators to adjust the die gap, such as to allow for variations in workpiece diameter. Although field operators may try to bend workpieces with a slightly different diameter than the bending machine was made, these slight changes in diameter can have a significantly negative affect on the shape and quality of the bends being formed. The workpiece can slip if the gripping pressure is reduced, or bind, break or increase wear if the workpiece is gripped too tight.

A further problem with conventional tube bending machine is its cost and difficulty to repair. Although some tube bending machines provide a hand wheel and screw assembly for setting the die gap, these machines are much more expensive. The cost of the wheel and screw assembly is significant. The wheel and screw assembly also requires a device such as a numerical counter so that the operator can repeatedly return the counter-die to the same desired position each time for repeating a particular bend on many workpieces. The operator must remember to write down the desired positioning number so that the wheel can be returned to this position each time. If the operator forgets to write down the positioning number, then they will not be able to accurately repeat the bend on a new workpiece. In addition, any damage to or wear and tear on this assembly requires immediate repair. Yet, this assembly is time consuming to remove and replace, and because of its significant cost, replacement parts are difficult to obtain, all of which leads to costly down time.

A still further problem with conventional rotary draw bending machines is operating efficiency and safety. During operation, a worker is constantly handling straight and bent pieces of tubing or piping. Straight tube must be properly placed in the machine by hand, and the bent tube must be removed from the machine by hand. Control switches are also operated by hand. Machine efficiency is reduced because a person can only reliably do one of these tasks at a time. The control switches also require the operator to be close to the machine to start and stop a bend. The worker must get close to the machine to turn it off even if something is noticeably wrong, such as a workpiece is binding, which could suddenly release in a snapping motion and injure the worker.

A still further problem with conventional rotary draw bending machines is their many hydraulic hoses. A variety of hoses are needed to balance the pressure and flow rate of the hydraulic fluid to the drive cylinders so that the drive rods extend symmetrically at the same rate. These hoses are not protected and can be easily crushed, punctured, cut or otherwise damaged in a busy construction site or manufacturing setting. The flex hoses also require many connections that can loosen or leak. Yet, hydraulic fluid leaks are both messy and lead to dangerous and slippery work conditions.

A still further problem with conventional tube bending machines is die change over time. Dies are frequently changed during operation. Yet, the dies on many machines are difficult and time consuming to change. Many conventional tube bending machines typically require special tools or the removal of several parts to change either the bending die or the counter die. Accordingly, a significant down time occurs each time a different radius bend is formed or a different diameter workpiece is loaded. Moreover, should a part that needs to be removed to change a die become jammed, stripped or damaged, the entire machine may become inoperable until it is repaired.

A still further problem with conventional tube bending machines is that they are bulky and difficult to move. A worker performing a project in a specific area of a construction site or manufacturing plant may have to haul large quantities of bulky, heavy tubing or pipe from one end of the site or plant to the other and back in order to perform his or her job. This is not only an unproductive use of work time, but can result in injury to the workers.

The present invention is intended to solve these and other problems.

BRIEF DESCRIPTION OF THE INVENTION

The present invention relates to a rotary draw bending machine and a process of using that machine to bend workpieces such as tubes or pipes into precise bends. The bending machine has a spindle holding a bending die, and a radial arm holding a counter-die. The spindle and arm are simultaneously rotated in opposite directions by the dual hydraulic drive. Each rotates half the desired bend angle. The desired bend angle is set by a dial with a triggering groove that are rotated relative to a fixed limit switch. The hydraulic drive moves the machine between a home positioned at 0° and the desired bend angle position. The machine is controlled by an electro-hydraulic control system with foot pedal controls. The radial arm has an alignment mechanism formed by a track that slidingly receives the counter-die assembly. A ratchet mechanism incrementally aligns the counter-die with the bending die. Ratchet teeth allow incremental advancement of the counter-die when aligning it with its bending die to accurately set the proper gap between the counter-die and bending die. The ratchet mechanism preferably includes a fine tuning device to provide an infinite range of adjustability for setting the die gap.

An advantage of the present tube bender is its die gap alignment mechanism. The alignment mechanism is located on the rotating arm and includes a slide track and ratchet mechanism. The alignment mechanism provides incremental, adjustable positioning of the counter-die relative to the bending die. The saw-tooth shape of its ratchet teeth and the tip shape of the ratchet arm allow forward sliding movement of the counter-die assembly, and selectively prevent rearward movement. This incremental sliding movement positions the counter-die near the bending die with a relatively small, but necessary, incremental gap between them. A gap of about ⅛ inch between the ends of the dies is common. This gap ensures that the counter-die properly holds and maintains contact with the tubular workpiece during the bending operation. The counter-die snuggly presses the workpiece, but not so tight as to cause undesired binding. An overly tight grip causes the workpiece to bind with the counter-die, which causes the workpiece to slip through the hook of the bending die. Too loose of a grip and the workpiece will disengage from the counter-die in the critical bend forming region, which results in an improperly rounded or flattened bend surface.

Another advantage of the present tube bender is the speed, ease of use and reliability of the gap alignment mechanism. The machine and its ratchet assembly are designed for use with a wide variety of dies and a wide variety of workpiece diameters. Each bending machine includes several sets of dies. Each set is made for a certain workpiece diameter (e.g. 2 inch ASTM schedule 40 pipe). Each die set includes one counter-die and several corresponding bending dies. The bending dies are typically made in standard radial increments, such as 3 inch, 3¼ inch, 3½ inch, 3¾ inch, 4 inch, 4¼ inch, etc. When the tubes or pipes being bent at a job site have the same diameter, or multiple bends are formed into various tubes or pipes, then the same set of dies is used for multiple bends of various radii. In these situations, the same counter-die is used, and the bending dies are changed to change the bend radius. The bending die and counter die are removably secured to their respective mounting brackets to facilitate quick die changes. The alignment mechanism is particularly fast and easy to use in these situations, because the change in the die gap basically corresponds in a one-to-one ratio to the change in the radius of the bending die, and the change in the radial increments of the bending dies is a multiple of the incremental ratchet length. For example, when the die gap is set for a 4¼ inch radius bending die, then switching to a 3½ inch radius bending die requires move the counter-die forward ¾ inch. This sliding movement is easily accommodated by the alignment mechanism because each ratchet tooth has a length sized to provide a desired uniform incremental advancement of the counter-die along the track relative to the bending die. The length of one tooth is an integer fraction of the difference in the radii of two bending dies. For a bending machine that includes bending dies with these radii, the ratchet teeth have a length of ⅜, ¼, ⅛ or 1/16 inch. This allows the counter-die to be easily slid into position with the 1½ inch bending die with the desired ⅛ inch gap by simply sliding the counter-die assembly forward three, six or twelve teeth, respectively. This simple motion is performed quickly when changing bending dies, to accurately align the dies with the desired gap between them. A template can be placed over the ratchet assembly, or the ratchet assembly can be directly marked, to indicate the proper ratchet slot for each bending die in a particular set. Quickly and accurately setting the gap is important because the bending machine is constantly being reset to form a different radius bend or bend a different diameter pipe. The initial setting of the die gap effectively sets the die gap for each of the bends, even when the bend radius changes throughout the day. Thus, the alignment mechanism minimizes worker frustration, increases the speed of setting the gap and reduces scrap, which results in less material waste, improved labor efficiency, and less drain on tubing or piping inventor. Costly time delays to obtain additional inventory are avoided, which is particularly advantageous when the pipe being bent is required to begin or complete other work, such as erecting scaffolding or installing electrical conduit runs.

A further advantage of the present tube bending machine is its inexpensive cost. The alignment mechanism uses component parts that are easily and inexpensively manufactured to produce a machine that accurately sets and adjusts the die gap. The track and ratchet assembly are cost effective and durable. When necessary, the ratchet assembly can be easily removed and replaced, without undue expense or down time.

A still further advantage of the present tube bender is its quick release mechanism. The counter-die can be swung to the side to release or insert a workpiece, and back again into proper aligned engagement with the workpiece. The quick release mechanism does this without moving the counter-die assembly, so that the proper die gap setting is maintained. The quick release improves the operational efficiency of the tube bender because die gap does not need to be reset when the machine is used to make consecutive bends of the same radius to a single piece of pipe or pieces of pipe with the same diameter.

A still further advantage of the present tube bender is that it firmly holds and locks the counter-die assembly in place. Maintaining the proper position of the counter-die is important because the counter-die exerts up to about 4,000 pounds of force on the pipe during operation as the machine draws or pulls the pipe around the bending die. The track and ratchet mechanism allow quick positioning of the counter-die assembly. The assembly also includes two locking bolts that absorb the large bending forces. These bending forces are not seen by the ratchet mechanism to any significant extent, which would increase the wear rate of its teeth and pivot mechanism, and reduce the precision of its incremental alignment function. The pivot post of the quick release mechanism includes one of the locking bolts. When tightened, the bolt compresses the pivot post, which increases its torque resisting strength. The second locking bolt provides extra support to filmy hold and lock the counter-die assembly in place on the slide track of the rotating arm.

A still further advantage of the present tube bender is its fine tuning mechanism for setting the die gap. The fine tuning mechanism includes a circular rotatable hub with an offset shaft to secure the hub and the ratchet mechanism to the rotatable arm. The offset between the center of the hub and the center of its securement shaft is at least substantially equal to half the length of one ratchet tooth. Hub rotation positions the counter-die half a tooth forward or half a tooth backward. Thus, in combination with the incremental alignment and adjustability of the die gap provided by the teeth of the ratcheting mechanism, the fine tuner provides an infinite range of adjustability for setting the die gap. Fine tuning is particularly useful to adjust for the imprecise nature of a real world working environment. First, the fine tuner allows the track and ratchet alignment mechanism to adjust for slight variations in pipe diameter due to pipe manufacturing tolerances. The fine tuner adjusts the die gap alignment for situations where one batch of pipe has a slightly larger or smaller diameter than another batch of the same diameter pipe. Second, the fine tuner allows the track and ratchet alignment mechanism to adjust for wear in the groove of the counter die or bending die. Third, the fine tuner allows the operator to controllably adjust the die pressure for more aggressive bend profiles, such as when the counter-die groove is a more eccentric elliptical shape, or out of round, similar to a curved V-shape. This type of more pronounced bend profile or aggressive bending requires more metal flow in the bend region and higher counter-die pressures to ensure the tube or pipe remains flush with the surface of the counter-die groove.

A still further advantage of the present tube bender is its smooth operation and range of bending motion. The dual hydraulic drive balances the large bending forces and torques, which reduces wear and tear, and maintenance down times. The dual hydraulic drive also allows for 180 degree bends. This range of motion is a significant advantage over bending machines that are limited to 90 degree bends, because these other machines are simply not capable of meeting project requirements. Only unusual bends exceed 180 degrees, and these bends are typically special ordered. Thus, the dual hydraulic drive provides the range of motion needed for a wide array of job situations.

A still further advantage of the present tube bender is its operating efficiency and improved safety. Foot pedals are used to activate forward and reverse movement of the hydraulic drive mechanism. The hands of the operator are free to load and unload pieces of tube or pipe. The foot pedals are connected to the machine by a control cord and can be located a safe distance from the machine. The worker does not have to be close to the machine to turn it on and off. If something is noticeably wrong, the operator can deactivate the hydraulic drive by releasing the foot pedal before approaching the machine.

A still further advantage of the present tube bender is its hydraulic fluid pressure and flow distribution controls. An electric circuit controls the pressure and flow of hydraulic fluid to the two hydraulic cylinders, which eliminates the need of several hydraulic hoses, particularly the unprotected hoses. The remaining hydraulic hoses are inside the frame and housing of the bending machine, where they are protected from being crushed, punctured, cut or otherwise damaged. The elimination of flex hoses also reduces the chance of messy and slippery leaks that can lead to dangerous work conditions. The elimination of the hoses and their connections also reduces the overall cost of the machine.

A still further advantage of the present tube bender is the ease and speed with which dies can be changed. Conventional tools such as commonly available wrenches are used to change the bending die. No tools are needed to change the counter-die. Moreover, die changes do not require the removal of additional parts. This reduces die change down time, and reduces or eliminates possible down time caused by jamming, stripping or damage to fasteners and other components during a die change.

A still further advantage of the present tube bender is its compact size and portability. The machine can be easily transported to a particular area of a construction site or manufacturing plant where tube bending operation are most safely and economically performed. The need for workers to haul large quantities of bulky, heavy tubing or pipe from one end of the site or plant to the other is reduced or eliminated. This improves overall side work productivity, and reduces the possibility of injury.

Other aspects and advantages of the invention will become apparent upon making reference to the specification, claims and drawings.

DESCRIPTION OF THE PREFERRED EMBODIMENTS

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Figure 5:
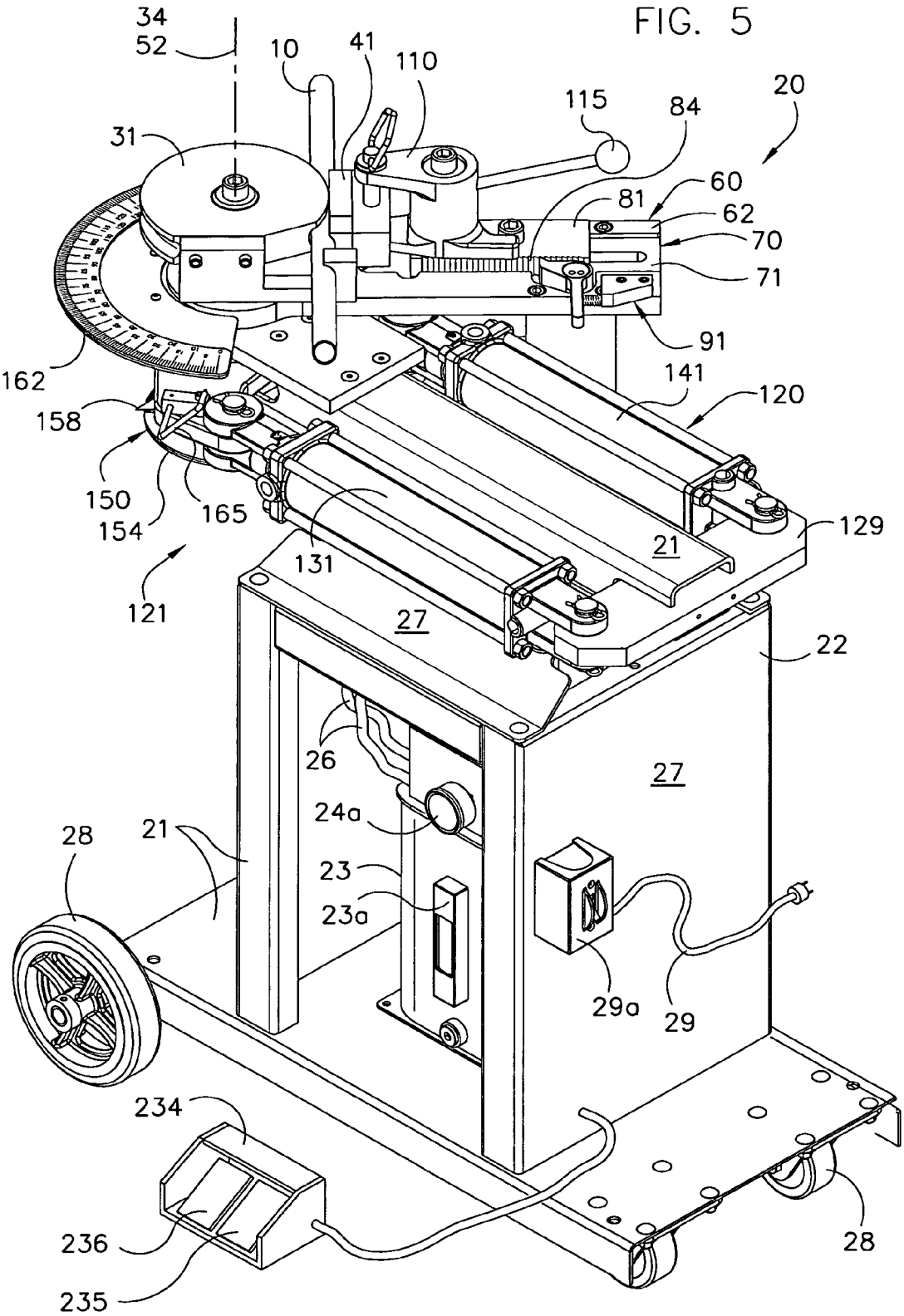
FIG. 5 is a perspective view of the present rotary draw, tube bending machine invention having a dual hydraulic drive that rotates a spindle holding a die and a rotating arm holding a counter-die, the rotating arm having a ratchet assembly or mechanism allowing incremental adjustment of the counter-die to set the gap with the bending die, and having a foot-controlled electro-hydraulic control system.
Figure 6:
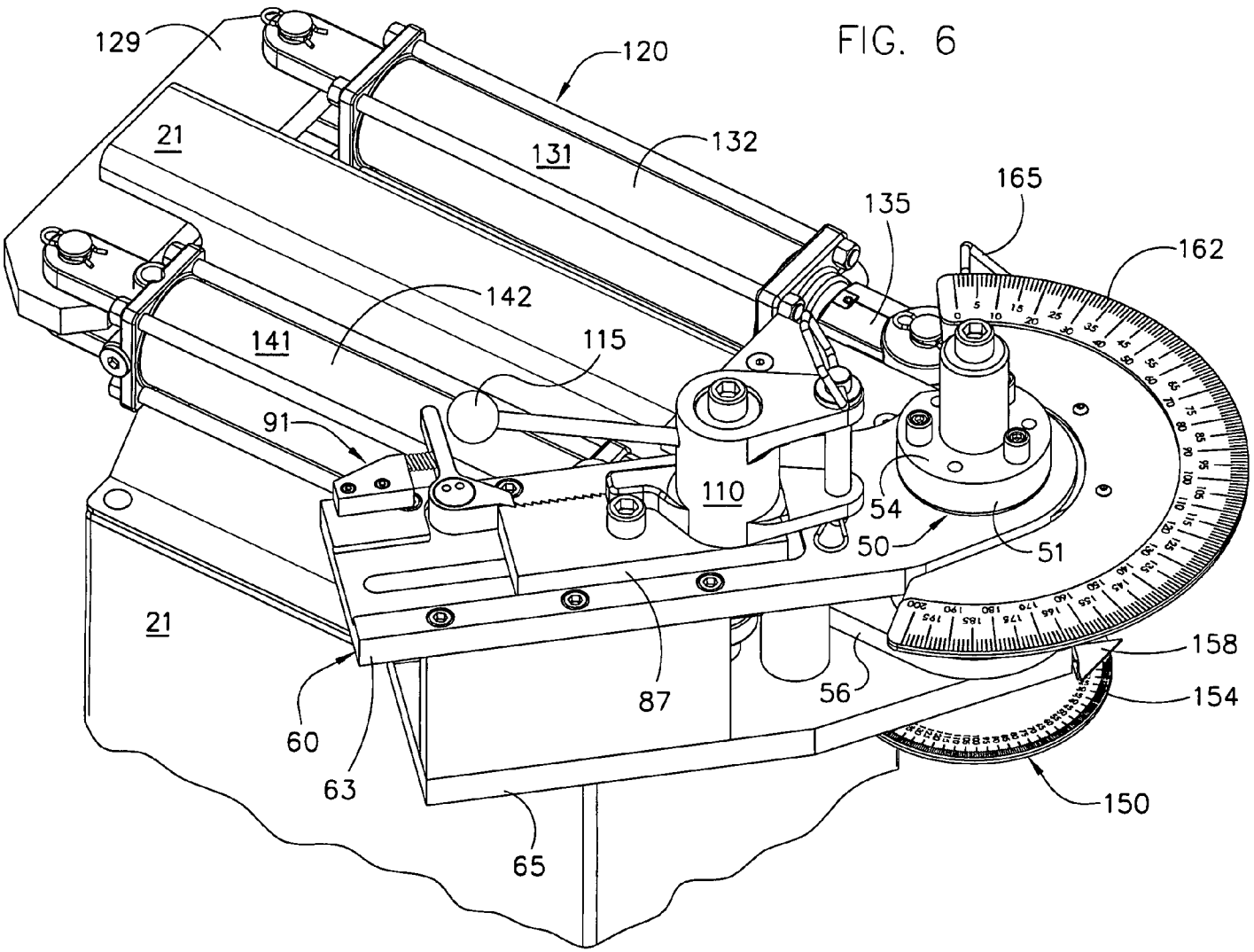
FIG. 6 is a partial perspective view of the present tube bending machine showing the hydraulic drive and rotating arm in their home position and showing the counter-die mounting assembly and ratchet mechanism at a forward position.

The present invention relates to a rotary draw tube bending machine generally designated by reference number 20 in FIG. 5. The bending machine 20 has a power operated, rotating drive spindle. The tube bending machine or tube bender 20 has a frame 21 that forms a lower shelf or cabinet 22 and two upper platforms. A hydraulic fluid reservoir 23 is located in the cabinet 22. The reservoir 23 includes a fluid level indicator 23*a* and a filter 23*b*. A conventional pump 24 is used to pressurize the fluid to about 2,200 to 2,500 pounds per square inch (psi), which is indicated by a pressure gauge 24*a*. Hydraulic flex hose 25 transmits pressurized hydraulic fluid for extending the drive cylinders discussed below. Additional hydraulic flex hose 26 transmits pressurized hydraulic fluid for retracting the cylinders as discussed below. A sheet metal housing 27 forms the cabinet 22 and other portions of the frame 21. The frame 21 is mounted on four wheels 28 and casters for portability. The frame 21 includes a mount for holding a power cord 29 that feeds into an ON/OFF switch 29*a*. The machine 20 is robustly designed with components made from solid steel bar stock. The weight of the machine 20 including its frame 21 and hydraulic reservoir 23 is about 510 lbs. The center of gravity of the machine 20 is kept low and between its wheels 28 for stability.

Figure 1:
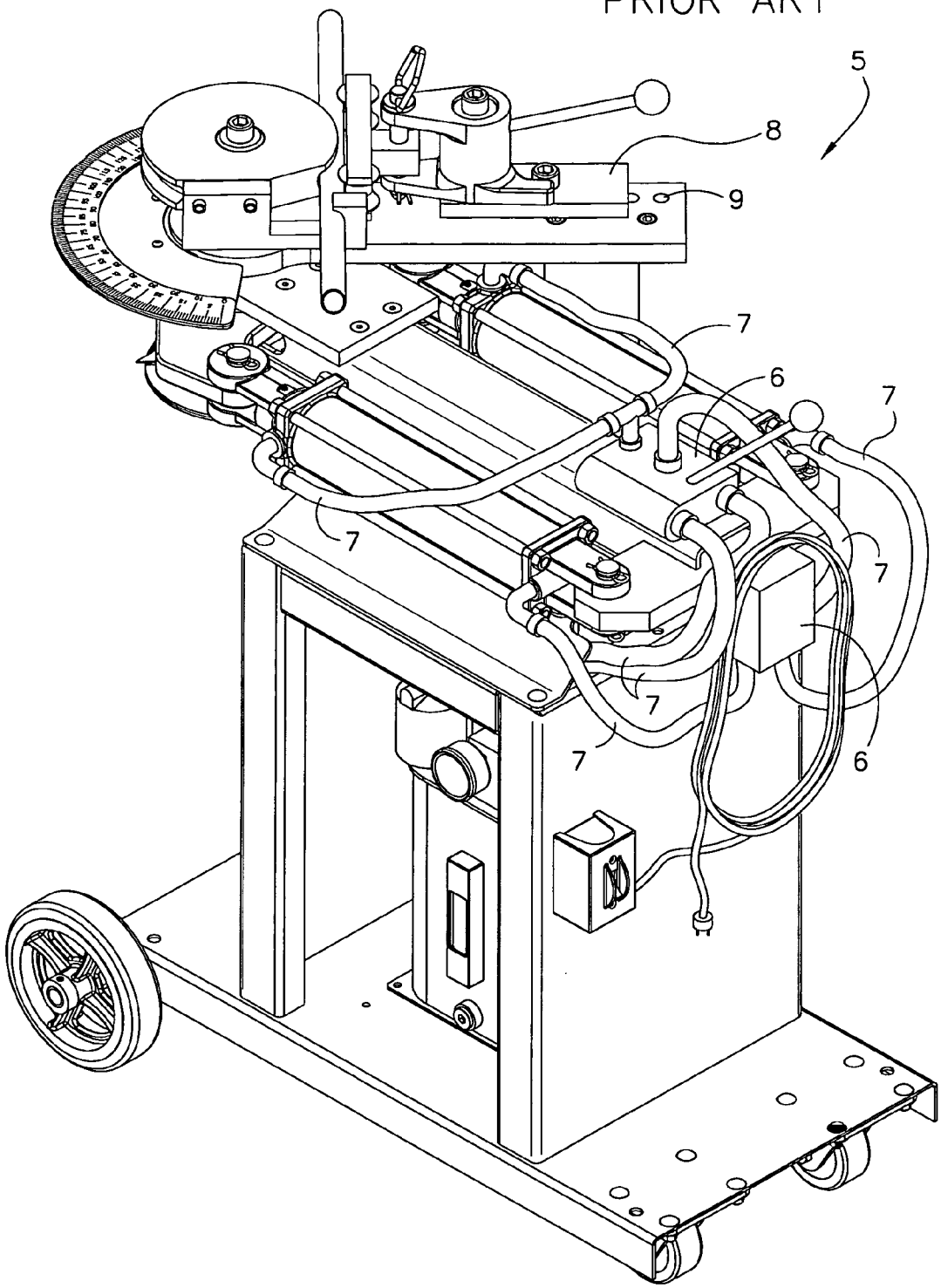
FIG. 1 PRIOR ART
FIG. 1 is a perspective view of a conventional rotary draw, tube bending machine having a dual hydraulic drive that rotates a spindle holding a die and an arm holding a counter-die bolted to one of a few fixed positions determined by linearly aligned bolt holes, and using a hand-controlled, mechanical pressure splitting hydraulic control system.
Figure 2:
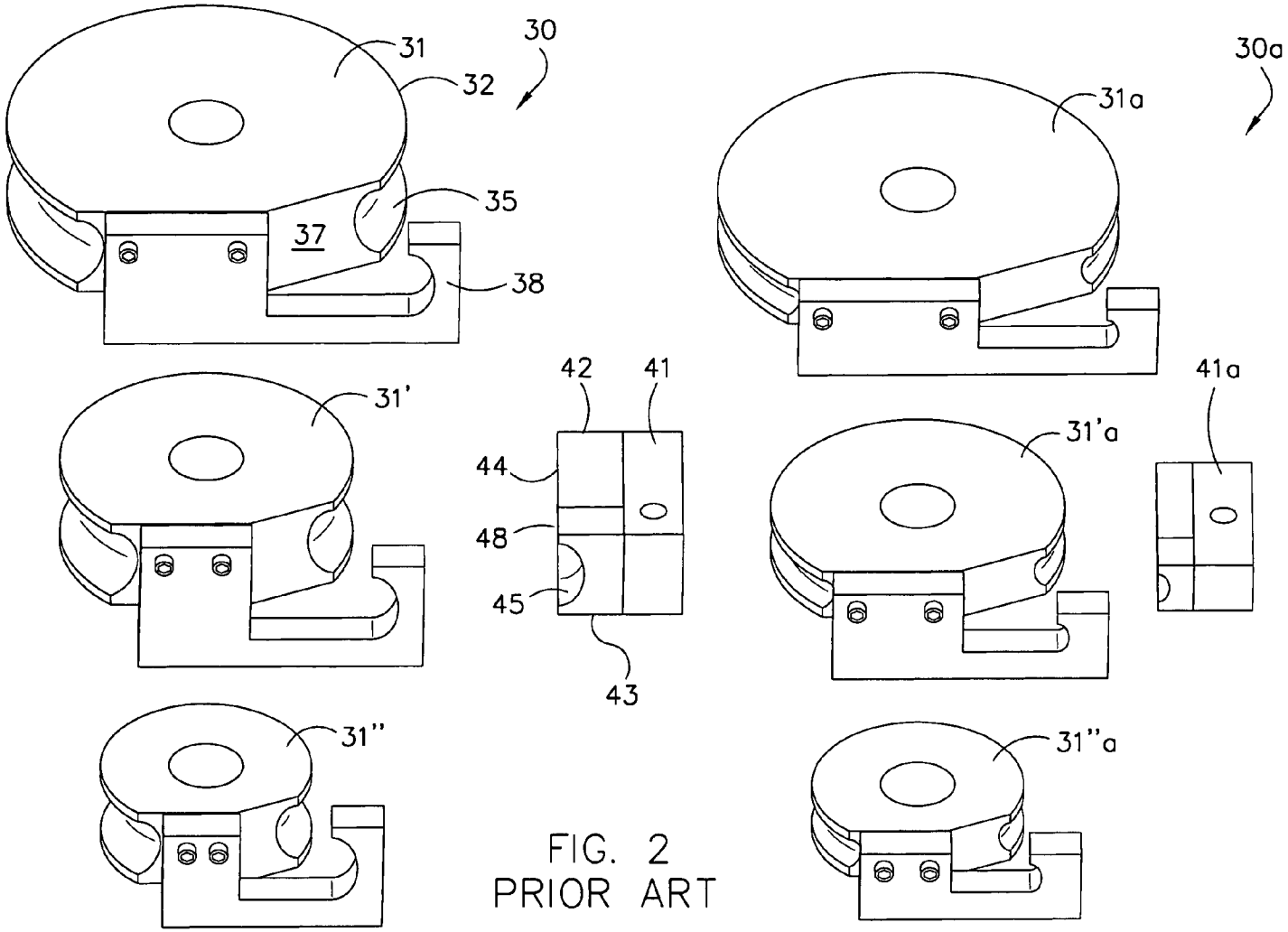
FIG. 2 PRIOR ART
FIG. 2 is a perspective view showing two sets of conventional dies, each set including several bending dies and a corresponding counter-die for a tube or pipe workpiece having a specific diameter.
Figure 3:
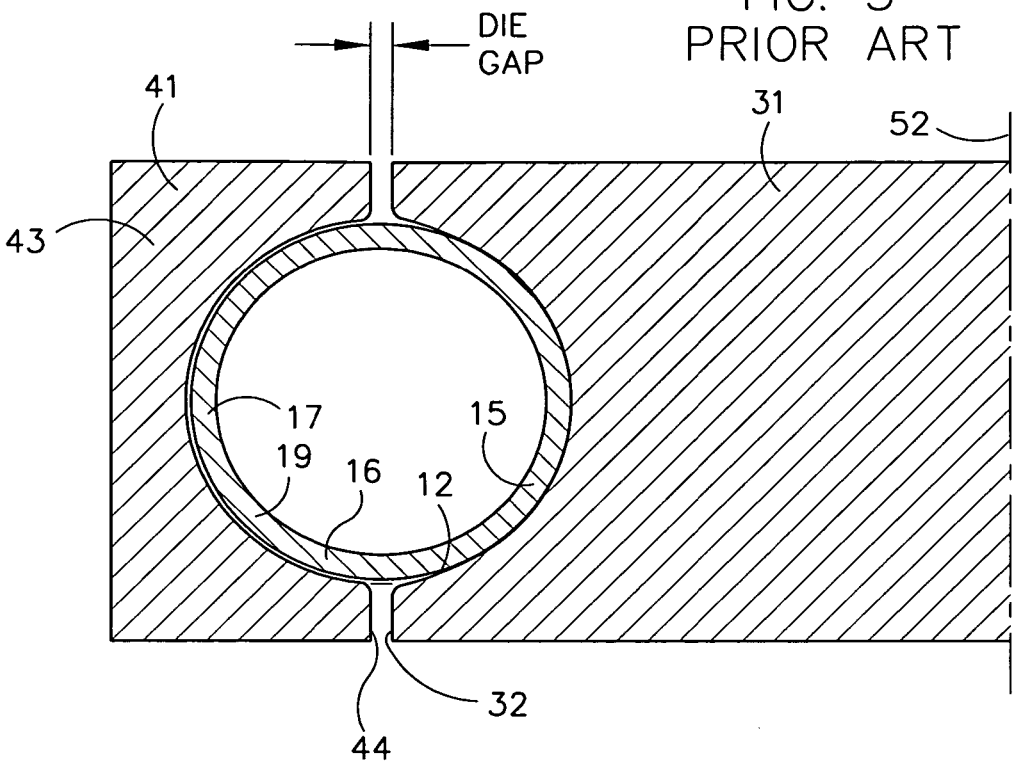
FIG. 3 PRIOR ART
FIG. 3 is a sectional view showing the rounded shape of a pipe as it exits the counter-die when the die gap is properly set and the pipe flushly engages the elliptically shaped groove in the bending region of the counter-die.
Figure 4:
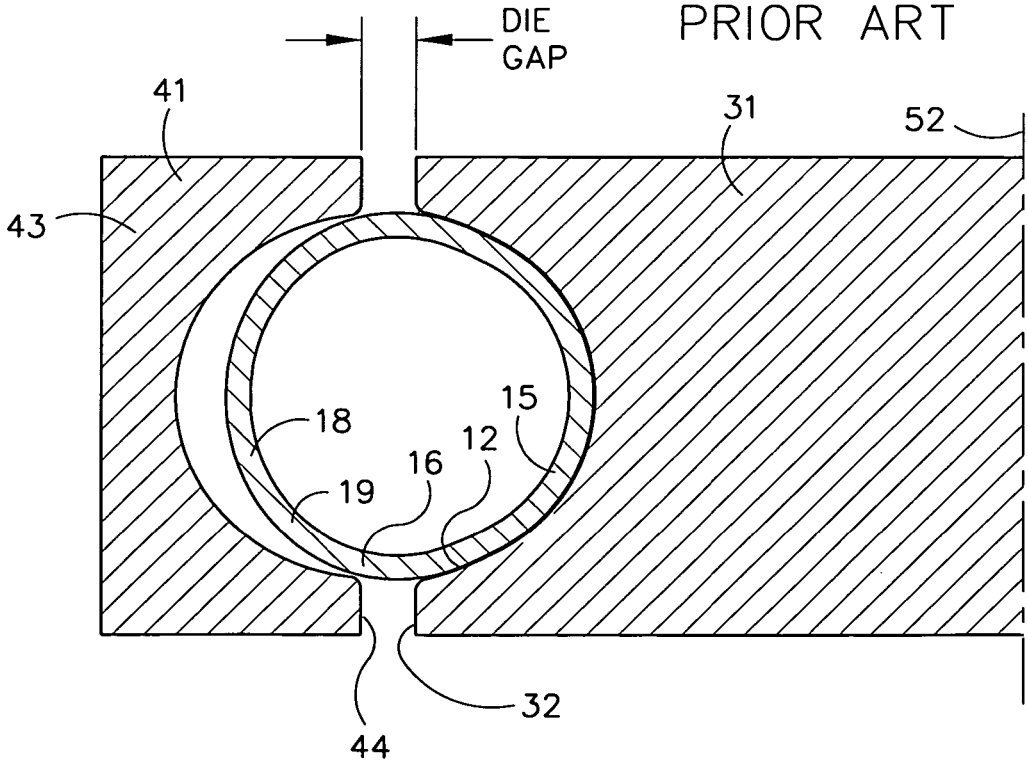
FIG. 4 PRIOR ART
FIG. 4 is a sectional view showing the flattened shape of a pipe as it exits the end of a counter-die when the die gap is too large and the pipe pulls away from the groove of the counter-die.

The tube bender 20 includes several die sets 30, 30*a*, etc., as shown in FIG. 2. Each die set 30, 30*a* includes several bending dies 31, 31', 31" or 31*a*, 31*a'*, 31*a"* and a corresponding counter die 41 or 41*a*, respectively. Each die set 30 and 30*a* typically includes large 31, 31*a*, medium 31', 31*a'* and small 31", 31*a"* bending dies, respectively. Each bending die 31, 31*a* has a two-piece construction. The main body of the die 31, 31*a* has a generally circular perimeter or outer rim 32 that defines a central axis 34 of the die. A hemispherical shaped, concave groove surface 35 is formed into the outer perimeter 32 of the die 31 or 31*a*. This uniform groove 35 extends around the circumference of the die 31, except in a flat portion 37 of the die. The flat, angled portion 37 forms a surface for removable bolting or otherwise securing a hook 38 to the main body. The hook 38 grips and holds a workpiece 10 during the bending process. The angled portion 37 allows the operator to more easily remove a workpiece 15 after it is bent as desired.

Each counter die 41, 41*a* has a generally rectangular body with leading and trailing ends 42 and 43. Each counter die 41, 41*a* has a 2-piece construction with a longer plastic portion proximal the leading end 42, and a shorter bronze portion proximal the trailing end 43. The metal portion forms the working portion of the counter die 41, 41*a*. Both portions of the counter die 41 form a flat, outer end 44 with a linear concave groove surface 45 formed therein. This uniform shaped groove 45 extends continuously from the leading end 42 to the trailing end 43 of the die. The grooves 35 and 45 of the dies have a uniform diameter or elliptical shape, respectively, to matingly engage a tube or pipe with a specific diameter. The tube bender 20 is designed to bend pipe and tubing 10 up to about 2½ inches in diameter. Although the cross-sectional shapes of the grooves 35 and 45 of the dies 31 and 41 are shown and described as being generally circular or elliptical, and the workpiece 10 is described as being a pipe or tube with a tubular shape, it should be understood that the cross-sectional shapes of the grooves 35 and 45 and workpieces 10 could be square, rectangular, octagon, etc., without departing from the broad aspects of the invention.

Figure 10A:
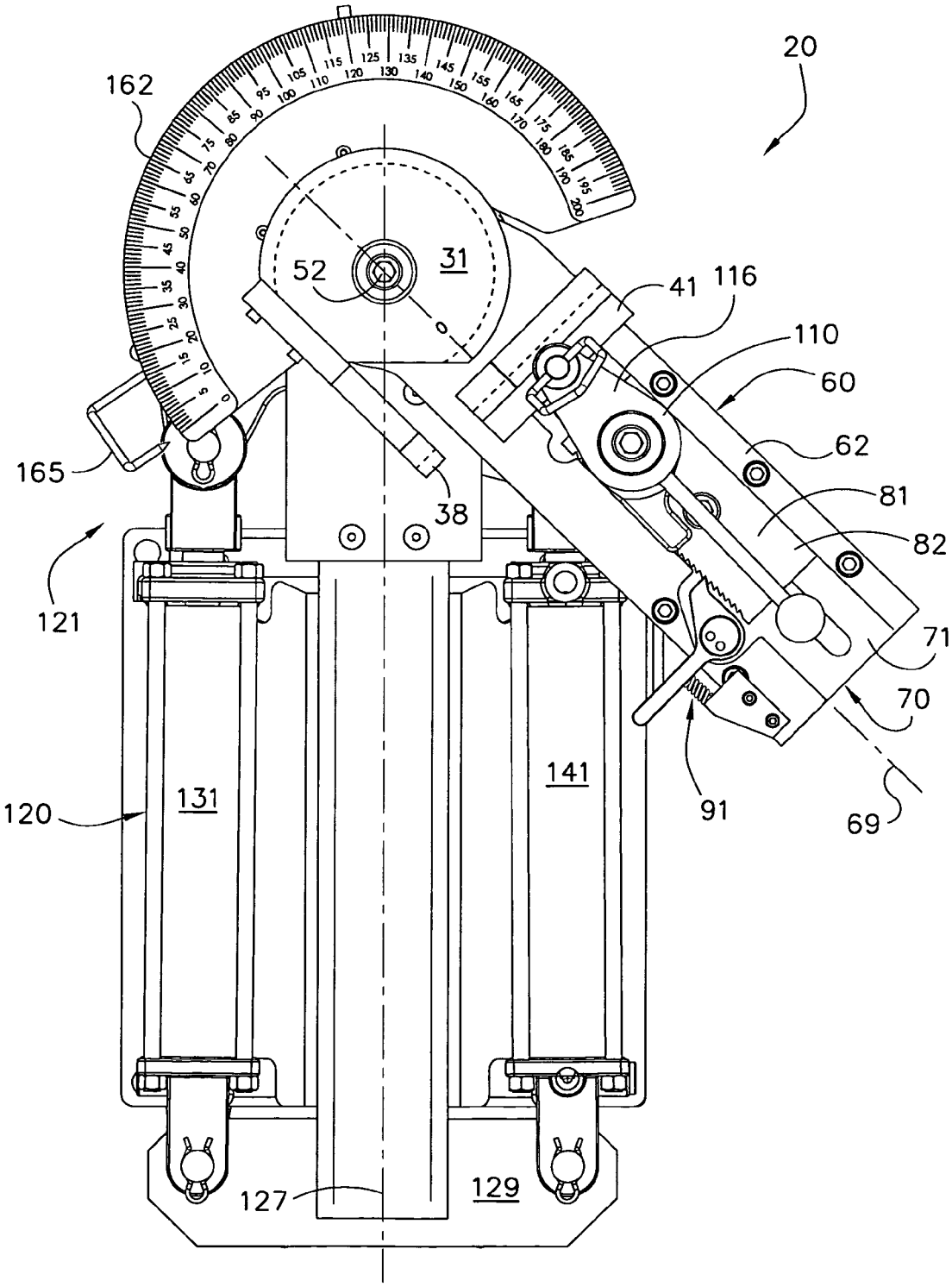
FIG. 10A is a partial top view of the present tube bending machine in its home position with a die secured to the spindle and a corresponding counter-die pivotally secured to the counter-die mounting assembly, and showing the ratchet assembly aligning the counter-die at a desired position with the front edge of the counter-die a desired distance from the outer edge of the die.

During the bending process, the tube or pipe workpiece 10 is pulled or drawn through the groove 45 of the counter-die 41 via the hook 38 of the bending die 31. The path of travel 47 of the workpiece 10 is best shown in FIG. 10D. The workpiece 10 is fixed to the bending die 31, and bent around the groove 35 of the bending die 31 to form the desired bend radius in the workpiece. The workpiece 10 is physically bent in a bend forming region 48 located in the metal portion of the counter-die adjacent its trailing end 43. The flow of metal in the workpiece 10 occurs in this region 48 of the die as the bend is being formed. The main body of the counter-die 41 has a hole for receiving a mounting pin 113, as discussed below. This hole is set back from and perpendicular to the groove 35. Although the following description of the machine 20 generally refers to bending die 31 and counter-die 41 for the sake of simplicity and readability, it should be understood that the other dies 31', 31" from that dies set 30, or dies 31*a*, 31*a'*, 31*a"* and 41*a* from another die set 30*a* could be uses.

The tube bender 20 includes a spindle assembly 50 that is best shown in FIGS. 6-9. The assembly 50 includes a generally circular spindle 51 that defines an axis of rotation 52. The spindle 51 rotates in a forward or clockwise direction when bending the workpiece 10. The spindle 51 has an upper surface 54 with three hardened pins that are unequally spaced to position and secure a selected bending die 31. The pins also drive the bending die 31 when the spindle 51 rotates. The bending die 31 has receiving holes on its underside to accept the pins. The spindle 51 has a central pin used to center the bending dies 31 on the spindle 51, and allows for easy positioning on the drive pins. When in place, the central axis 34 of the bending die 31 is directly in line with or coaxial to the axis of rotation 52 of the spindle 51 and machine 20. The spindle 51 and bending die 31 are fixed together and rotate in unison. The spindle 51 is rotatingly mounted to the upper platforms of the frame 21 by a mounting bracket 56 that includes a rotatable bearing (not shown). The mounting bracket 56 is rigidly secured to the spindle 51 and driven by a drive arm 57. The drive arm includes a hole or pivot point 58 for securing to a drive cylinder as discussed below.

Figure 11:
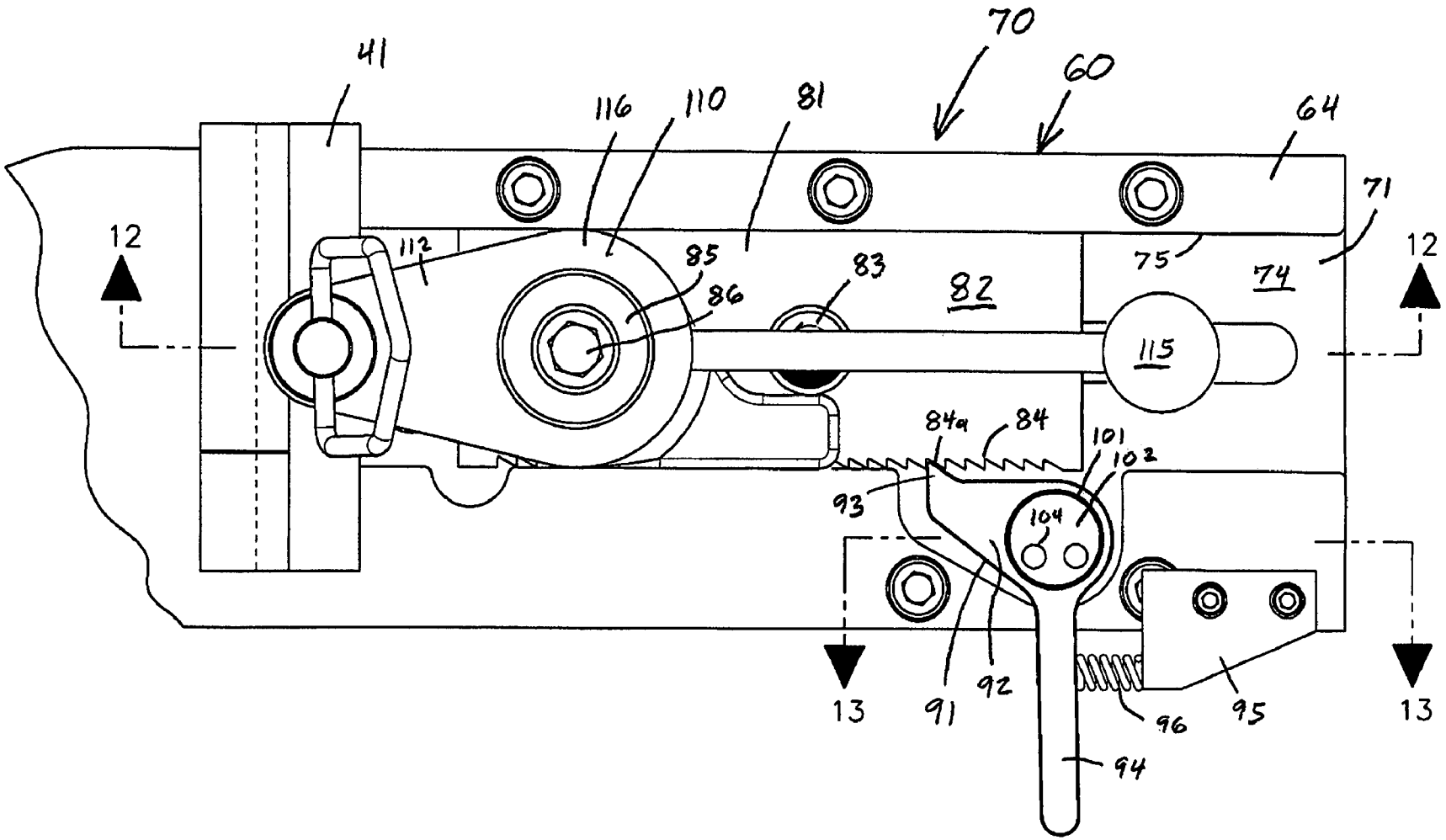
FIG. 11 is a partial top view of the counter-die and ratchet assemblies.
Figure 13:
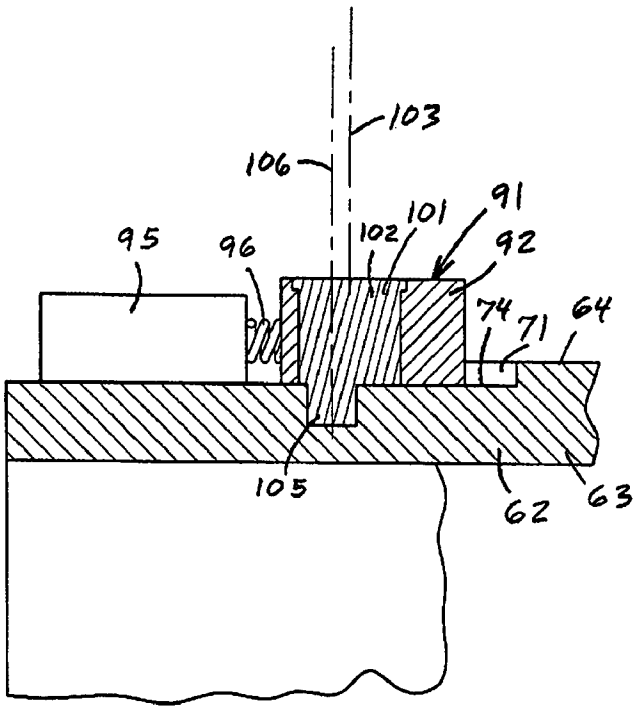
FIG. 13 is a side sectional view of FIG. 10 showing the bolts for fixedly securing the base of the counter-die assembly to the track of the radial arm.
Figure 12:
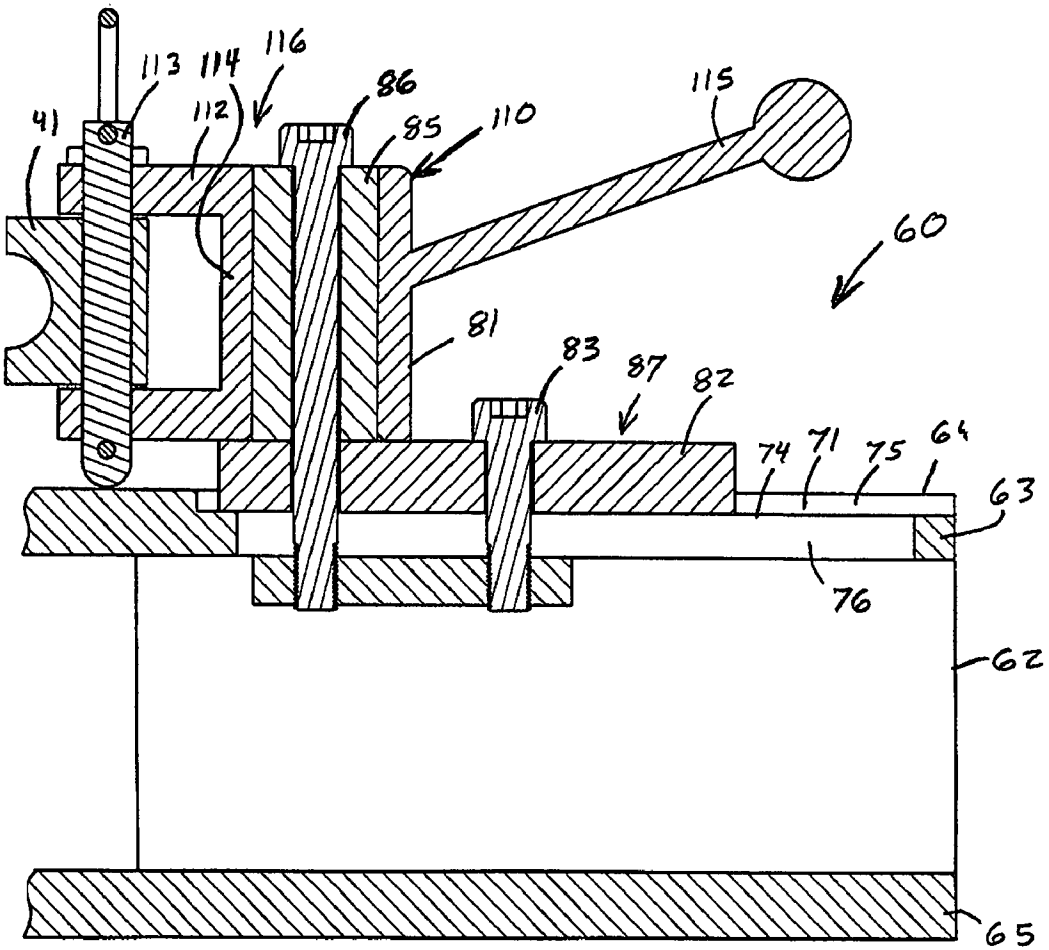
FIG. 12 is a side sectional view of FIG. 10 showing the offset of the ratchet mechanism.

The tube bender 20 also includes a rotating arm assembly 60 that is rotatably secured to one or both of the upper platforms of the frame 21. The arm assembly 60 rotates about the same axis 52 as and independently of the spindle 51. The assembly 60 includes a radial arm 62 that extends outwardly from the spindle 51. The arm 62 includes an upper plate 63 with an upper surface 64 as shown in FIGS. 11-13. The radial arm 62 also includes a web and lower plate 65 for added strength. The upper and lower plates 63 and 65 are rotatingly mounted to the spindle assembly 50 via a mounting bracket 67 that includes a rotatable bearing (not shown). The radial arm 62 includes a rotating, radial axis 69 that extends outwardly from, and is substantially aligned perpendicular to and to intersect the axis of rotation 52 as shown in FIG. 10A.

The rotating arm assembly 60 has an alignment mechanism 70. The alignment mechanism 70 is formed by a guide track 71, a mating counter die assembly 81 and an adjacent cooperating ratcheting mechanism or ratchet assembly 91. The slide track 71 is formed in the upper plate 63 of the radial arm 62, and is parallel to the radial axis 69. The track 71 forms a recess in the upper surface 64 of the plate 63. This recess or slide track 71 is defined by its upper surface 74 and spaced linear walls 75. One track wall 75 is preferably linearly aligned with the radial axis 69. The track 71 extends linearly from the rear of the radial arm 62 towards the front of the rotating arm. The track 71 includes a linear slot 76 that passes completely through the plate 63. This slot 76 is provided to secure the counter die assembly 81 to the rotating arm 62.

The counter die assembly 81 is slidingly and guidably received by the track 71 of the radial arm 62. The counter die assembly 81 has a base 82 with spaced side walls that flushly engage the walls 75 of track 71. The base 82 includes a locking bolt 83 towards its rear end, which extends through the base and the slot 76 to releasably secure the base and counter die assembly 81 in place at a desired location on the track 71. One side wall of the base 82 has a number of ratchet teeth 84 formed therein. This toothed wall is flush with the track wall 75, and is aligned with the radial axis 69 of the radial arm 62 as shown in FIG. 10A. Each tooth 84*a* has a predetermined incremental length. The counter die assembly 81 and radial arm 62 are fixed together and rotate in unison.

A pivot post 85 is welded to the top surface of the base 82 towards its front end. The pivot post extends upwardly from the base 82, and has a cylindrical shape with a diameter of about two inches that defines its central axis. The central axis of the post 85 is offset 1½ inches from the radial axis 69. A second, longer locking bolt 86 passes through the center of the pivot post 85 and through the slot 76 to releasably secure the pivot post and base 82 along the track 71 in a manner similar to the other bolt 83. The head of each bolt 83 and 86 is flared to abut the upper surface of the base 82 or pivot post 85, respectively. The threaded ends of the bolts 83 and 86 mate with a clamp on the underside of the upper plate 63. These bolts 83 and 86 are tightened down to fixedly secure the counter die assembly 81 to the radial arm 62. When tightened, the longer locking bolt 86 compresses the pivot post 85 against the base 82 to increase the strength of the post and prevent the post from bending during use. The bolts 83 and 86 are loosened to allow the counter die assembly 81 to move along the track 71 between a forward position 87 shown in FIG. 6 and a rearward position 88 shown in FIG. 7.

The ratcheting mechanism 91 shown in FIGS. 5, 10 and 11 includes a ratchet arm 92 with a distal tip or finger 93. The ratchet arm 92 is pivotably secured to a recessed portion of the radial arm 62 adjacent a side wall 75 of the track 71 to allow its tip 93 to engage the teeth 84 of the base 82. The ratcheting mechanism 91 includes a release arm 94 for rotating the tip 93 away from the teeth 84, and a mechanism 95 for biasing the ratchet arm toward and into aligned engagement with one of the teeth 84*a*. This biasing device 95 preferably includes a spring 96. The ratcheting mechanism 91 allows the base 82 and pivot post 85 of the counter die assembly 81 to slide forward freely, but prevents the base 82 from sliding rearwardly when the tip 93 of the ratchet arm 92 is engaged with one of the teeth 84*a*. The release arm 94 is pushed to rotate the mechanism 91 and pull the tip 93 out of engagement with the teeth 84 so that the base 82 and pivot post 85 of the counter die assembly 81 can be slid rearwardly. The ratcheting mechanism 91 combines with the teeth 84 to allow the incremental radial movement or advancement of the counter die assembly 81 towards the front of the radial arm 62 to align the counter die 41 with the bending die 31, and set the die gap between them. Each tooth 84*a* has a predetermined, and preferably equal, length that is an integer fraction of the incremental difference in bend radius of the bending dies 31.

The ratcheting mechanism 91 preferably includes a fine tuning device 101 best shown in FIGS. 11 and 12. The fine tuner 101 includes a circular hub 102 that defines its central axis 103. Holes or recesses 104 are provided in the upper surface of the hub 102 to facilitate the selective rotation of the hub. The hub is pivotably secured to the upper plate 63 of the radial arm 62 via a post 105 that has a central axis 106. This axis 106 is offset from the axis 103 of the hub 102 and is equal to about one-half the length of a tooth 84A. This offset allows the rotation of the hub 102 to advance the ratchet mechanism 91 forward one-half tooth length, or rearwardly one-half tooth length along track 71 and radial axis 69.

The ratchet mechanism 91 combines with its fine tuning device 101 to allow an infinite range of alignment positions for the counter die assembly 81 along track 71, and thus provides an infinite range of adjustability for setting the size of the die gap. The fine tuning mechanism 101 is used to adjust and set a tooth 84*a* recess at a desired initial alignment position for that specific set 30 of bending dies 31 and corresponding counter die 41, such as set 30 and dies 31, 31', 31" and 41 or set 30*a* and dies 31*a*, 31*a'*, 31*a"* and 41*a* as in FIG. 2. Once the fine tuner 101 is rotated to set the ratchet mechanism 91 in this manner, each tooth 84*a* is properly located so that the alignment mechanism 71 can properly incrementally and radially align the counter-die 41 or 41*a* with each of the bending dies 31, 31' and 31", or 31*a*, 31*a'* and 31*a"* in that die set 30 or 30*a*, respectively, and set the appropriate die gap for the selected bending die in relation to the counter die. The fine tuner 101 is also used to controllably adjust the die pressure applied to the tube or pipe workpiece 10 so that the workpiece remains flush against the counter-die groove 35 during the bending process.

The counter die assembly 81 includes a swing bracket 110 with a pair of spaced arms 112 that hold the counter die 41. A pivot pin 113 passes through the arms 112 and a hole in the main body of the counter die 31 to pivotally secure the counter die to the swing bracket 110. The spaced arms 112 are joined together at a central portion 114 that defines a central opening. This opening snuggly and rotatably receives pivot post 85. A swing handle 115 is used to swing the bracket 110 into an engaged position 116 shown in FIGS. 5 and 10A, and into a disengaged position 117 shown in FIGS. 10B and 10E. The swing mechanism 110 swings the bracket counter-die 41 between these positions 116 and 117 to allow the machine operator to quickly load and unload workpieces 10.

The tube bender 20 is powered by a dual hydraulic drive mechanism 120. This drive mechanism 120 drives the machine 20 between its home position 121 shown in FIGS. 10A-10C, and a desired tube bending position 125 shown in FIGS. 10D-10E. The drive mechanism 120 has a line of symmetry 127 that is perpendicular to and intersects the axis of rotation 52. The drive mechanism 120 includes a mounting plate 129 secured to the upper platform at the rear end of the machine 20. The drive mechanism 120 is a dual hydraulic drive mechanism that includes two hydraulic cylinders 131 and 141. The cylinders 131 and 141 are secured symmetrically about and to opposite sides of the mounting bracket 129. Each cylinder 131 and 141 is positioned symmetrically and equidistant from the line of symmetry 127, which is generally centered over the frame for stability. The line of symmetry 127 serves as an effective drive axis where torque forces cancel out given the symmetrical orientation of the cylinders 131 and 141 to provide a smoother operating machine 20.

The cylinders 131 and 141 are double acting so that they can be powered to extend and retract. Each cylinder 131 and 141 has an outer shell 132 or 142 that is pivotally secured at one end to mounting bracket 129 via a mounting pin. Each cylinder 131 and 141 includes a drive rod 135 or 145, respectively. Drive rod 135 is pivotally connected to the drive arm 57 of the spindle assembly 50 by pivot pin 58. Drive rod 145 is pivotally connected to the rotatable or radial arm 62 by a pivot pin 68. During a bending or drive cycle, pressurized hydraulic fluid is delivered to a drive side 136 and 146 of the cylinders 131 and 141 to simultaneously extend the drive rods 135 and 145 from their home position shown in FIG. 10A-C to an extended position shown in FIG. 10D-E. This causes the bending die 31 and spindle 51 to rotate in a clockwise direction 138, and arm 62 and counter die 41 to rotate in a counter-clockwise direction 148. During a return cycle, pressurized hydraulic fluid is delivered to a return side 137 and 147 of the cylinders 131 and 141 to simultaneously retract the drive rods 135 and 145 back to their home position shown in FIG. 10A-C.

Figure 8:
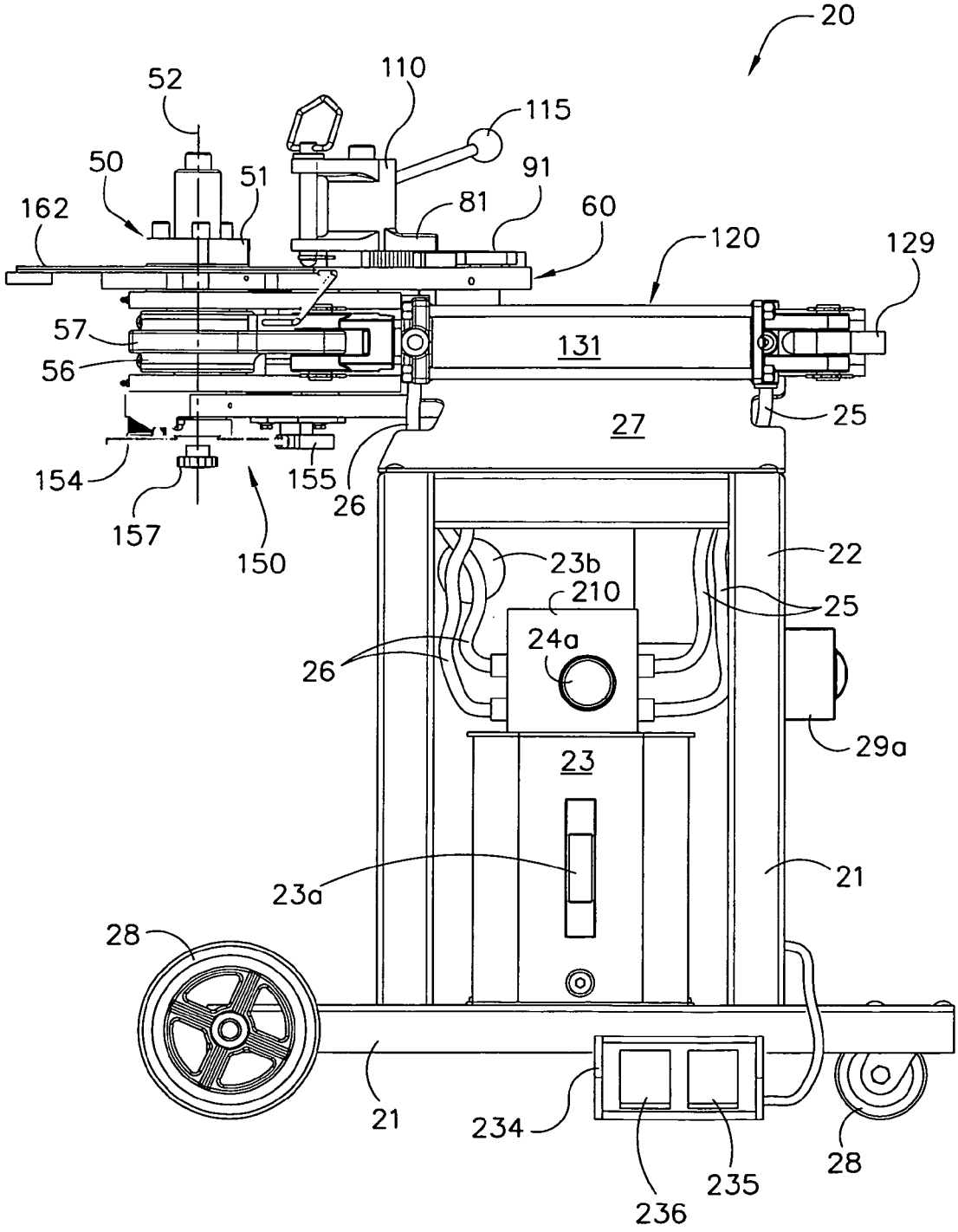
FIG. 8 is a side plan view of the present tube bending machine showing the hydraulic drive assembly for the spindle and the bend angle setting device secured to the upper portion of the machine frame, and showing the hydraulic fluid reservoir and pressure splitting chamber secured inside a lower compartment.
Figure 9:
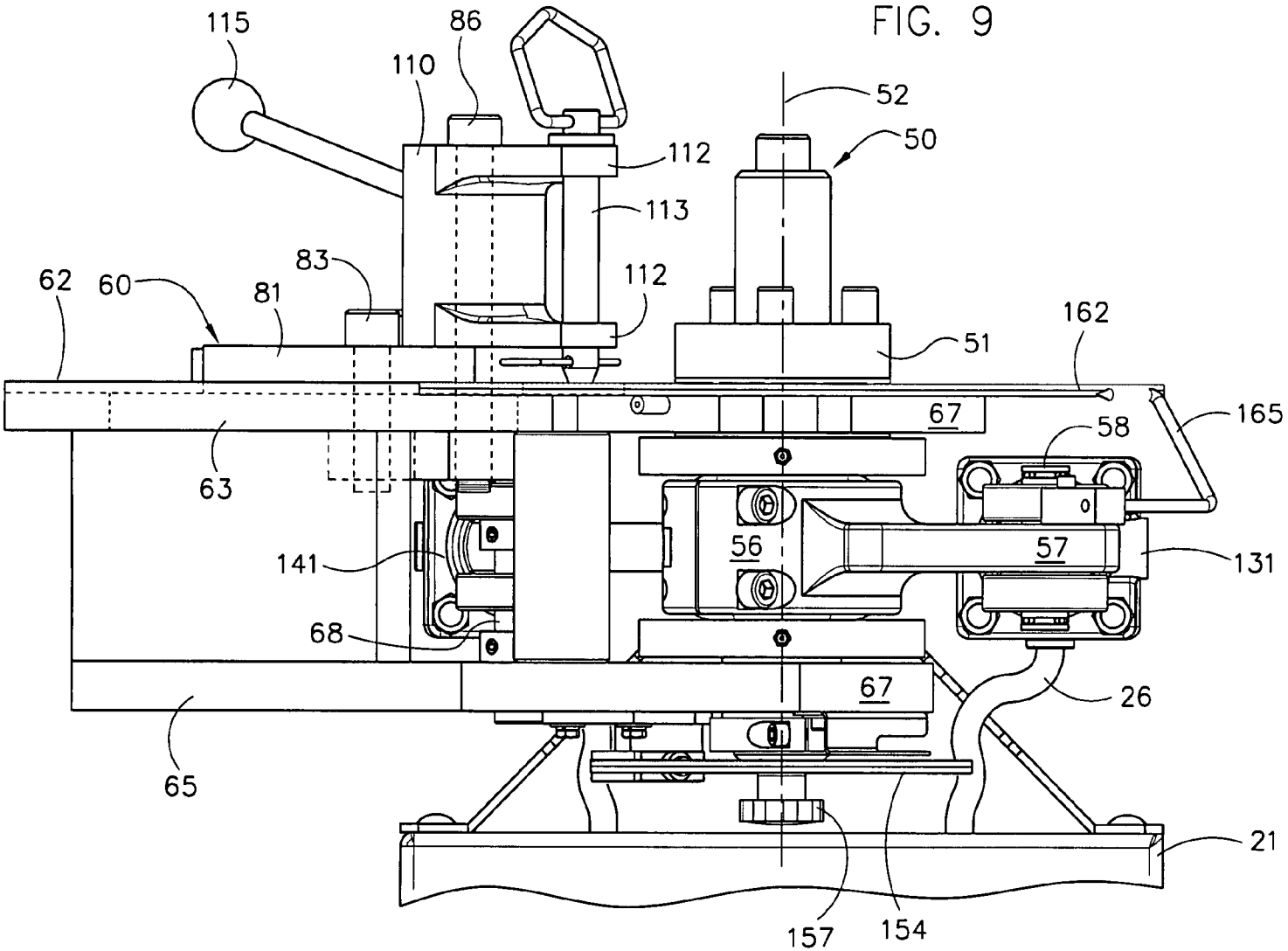
FIG. 9 is a partial front plan view of the present tube bending machine showing the hydraulic drive assemblies for both the spindle and the rotating arm, and showing the counter-die support assembly.

The desired bend angle for the workpiece 10 is set by an angle limiting device 150 shown in FIGS. 5, 6, 8 and 9. This device 150 includes a hemispherical shaped dial 154 with spaced incremental angular marks from 0° to 180° so as to resemble a protractor. This lower dial 154 is fixed to the underside of the spindle assembly 50 as shown in FIG. 8. The dial 154 rotates with the spindle 51 about the axis of rotation 52, and has a triggering groove formed into its outer edge or perimeter at a specific location. A limit switch 155 is rigidly fixed to the lower plate 65 and rotates with the radial arm 62. The limit switch 155 has a roller biased by a spring to pressingly engage and roll along the outer edge of the dial 154. During the bending cycle, when the roller reaches and moves into the groove, the limit switch 155 is triggered to stop the rotation of the spindle 51 and radial arm 62. The "stop" position is adjusted by rotating the dial 154 via knob 157 to set on the dial 154 at a desired bend angle. The angle limiting device 150 includes a pointer 158 bolted to the lower plate 65 of the radial arm 62. To set the desired bend angle, the dial 154 and its corresponding groove are rotated relative to the pointer 158 to the desired bend angle. The dial 154 is adjustable so that accurate bends of any angle up to 180° can be accomplished.

During the bending cycle and the extension of the drive rods 135 and 145, the triggering groove of the dial 154 rotates towards the limit switch 155. The triggering groove engages the limit switch 155 when the machine 20 reaches the predetermined desired angle of bend, such as the 120° bend angle shown in FIG. 10D. When the triggering groove of the dial 154 engages the micro switch 155, the hydraulic drive 120 stops, which in turn stops the rotation of the spindle 51 and bending die 31 and the radial arm 62 and counter-die 41 to produce the exact angle displayed on the dial. An upper indicating dial 162 is included so that the operator can more easily determine the progress of the bending and return cycles. A pointer 165 is positioned on the outside of the upper indicating dial 162, which also has angular degree demarcations like that of a protractor, to designate the currently existing incremental degree of bend of the machine 20 and workpiece 10.

Figure 7:
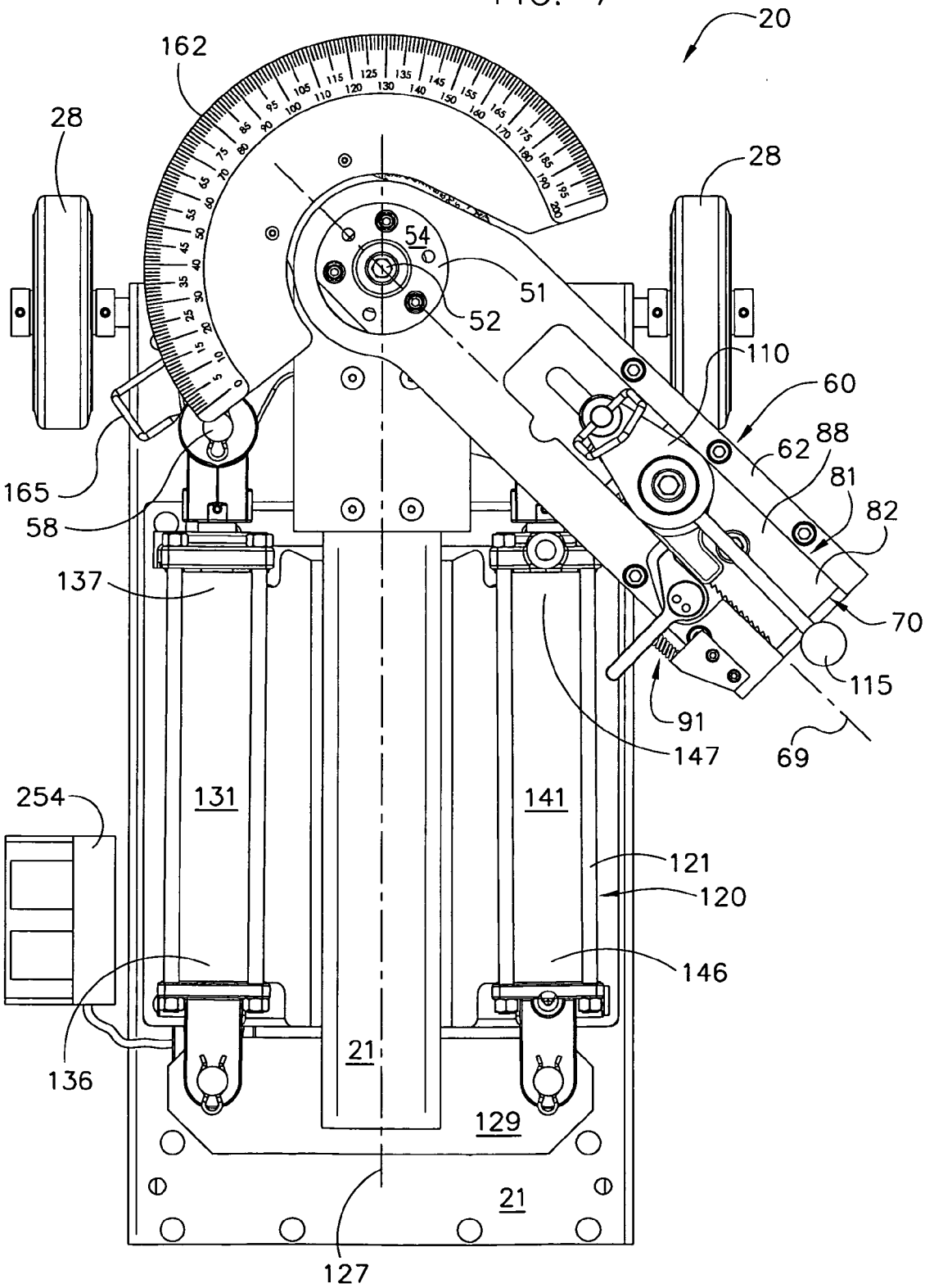
FIG. 7 is a partial top view of the present tube bending machine showing the hydraulic drive and rotating arm in their home position and showing the counter-die mounting assembly and ratchet mechanism at a rearward position.
Figure 14:
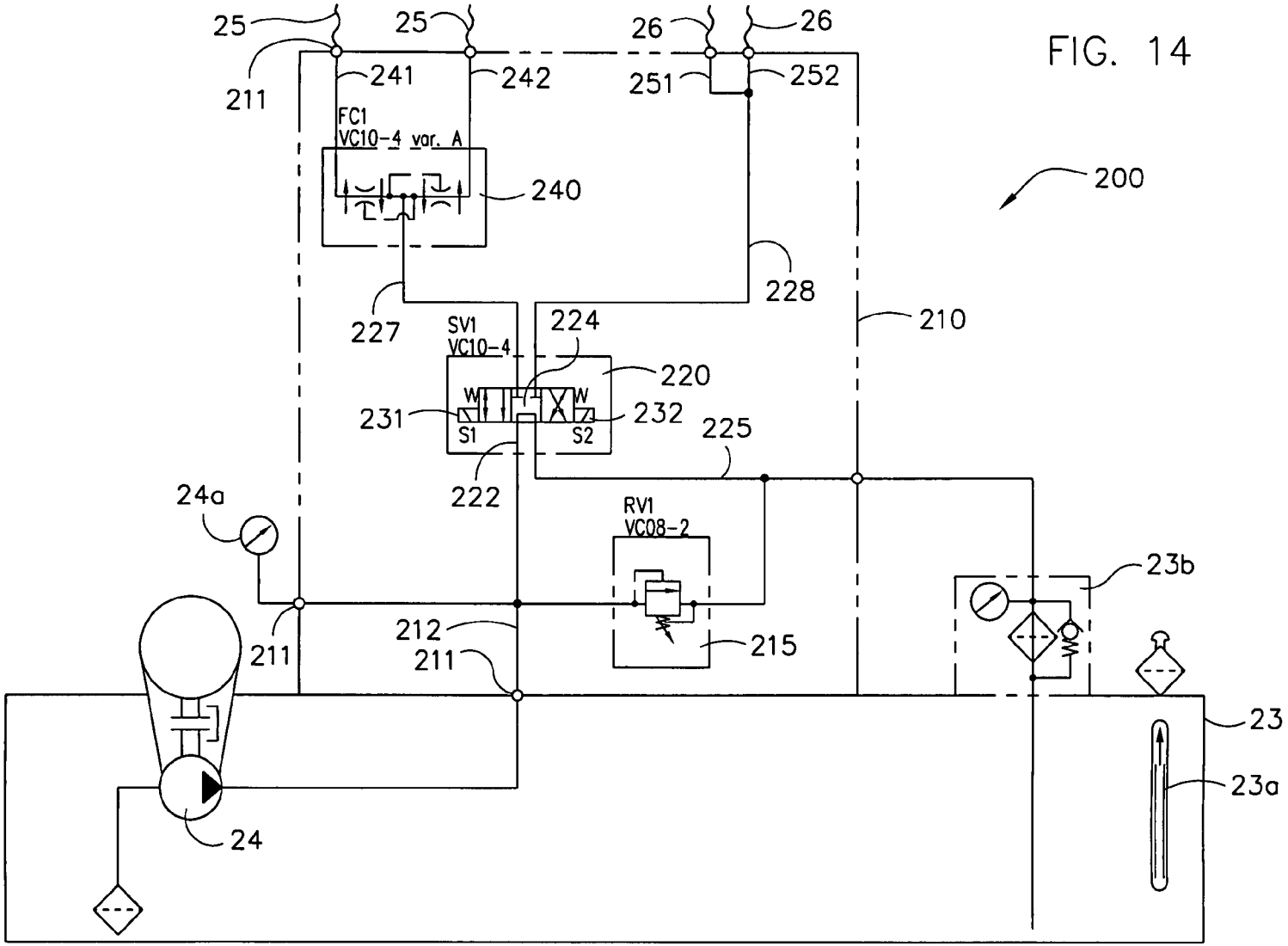
FIG. 14 is a schematic diagram of the electro-hydraulic control system.

The drive mechanism 120 selectively delivers hydraulic fluid to drive cylinders 131 and 141 via an electro-hydraulic control system 200 that is schematically shown in FIG. 14. A desired amount of fluid is stored in reservoir 23 as displayed by fluid level gauge 23*a*. When the control system 200 is electrically activated via on/off switch 29*a*, the pump 24 takes fluid from the reservoir 23, pressurizes it to about 2,400 psi, and discharges it into a manifold 210 resting on top of the reservoir 23 as shown in FIG. 7. The manifold 210 has a number of a ports 211 on its outer shell. Each port 211 provides a threaded connection for easy and leak-free securement of flex hose 25 and 26, and components such as filter 23*b* and pressure gauge 24*a*, which can be easily removed and replaced. The pressurized fluid enters the manifold 210 via a port 211 leading to an intake path 212. The intake path 212 is in fluid communication with the pressure gauge 24*a*, an internal pressure release valve 215 and a conventional solenoid valve 220. The pressure release valve 215 is set to a discharge pressure of 2,500 psi to protect the flex hose and other components of the bending machine 20 and control system 200.

The solenoid valve 220 has an intake path 222, an internal chamber 224, and three discharge paths 225, 227 and 228. The valve 220 is controlled by its two solenoids 231 and 232, which are in electrical communication with a foot pedal control unit 234 and its two foot pedals 235 and 236. The bending solenoid 231 is hard wired, via limit switch 155, to the bend cycle activating pedal 235. Return solenoid 232 is hard wired to return cycle activating pedal 236. Each pedal 235 or 236 is selectively depressed by the foot of the operator to an activated position. Depressing one of the pedals 235 or 236 energizes its corresponding solenoid 231 or 232, respectively. The limit switch 155 is electrically wired between bend pedal 235 and bend solenoid 231 to break the circuit and flow of electric power to the solenoid 231 when the switch 155 is triggered. The foot pedals 235 and 236 are biased up into a deactivated position. The valve 220 directs pressurized fluid along one of these paths 225, 227 or 228 by use of the pedals 235 and 236. When the tube bending machine 20 is in its home position 121 and activated, but neither foot pedal 235 or 236 is depressed, such as when the machine is not currently being used, then neither solenoid 231 or 232 is activated. In this condition, the valve 220 directs pressurized fluid along idle path 225, which leads back to the reservoir 23 after passing through the filter 23*b*. No pressurized fluid is delivered to either side 136, 137, 146 or 147 of the hydraulic cylinders 131 and 141, and the machine remains in its home position 121.

During the bending or drive cycle, the operator steps on the bend cycle foot pedal 235 to depress it into an engaged position. This activates the solenoid 231 of valve 220 to direct the flow of pressurized fluid to travel along bend or drive cycle path 227. The pressurized fluid of path 227 flows to a synchronizer or flow divider/combiner 240 that divides and simultaneously delivers the fluid at equal pressure to bending cycle paths 241 and 242. These paths 241 and 242 are fluidly connected via their respective flex hoses 25 to the drive sides 136 and 146 of the cylinders 131 and 141, respectively. This flow of pressurized fluid causes the drive rods 135 and 145 to simultaneously extend at the same rate, which simultaneously rotates the bending die 31 and spindle 51 clockwise 138 and the counter die 41 and arm 62 counter-clockwise 148, both at the same rate of rotation. The foot pedal 235 must remain depressed during the entire bending cycle to keep pressurized hydraulic fluid flowing to the cylinders 131 and 141, until the machine 20 reaches its desired bend position 125 as in FIG.

10D. Should the operator remove his or her foot from the pedal 235, the solenoid valve 220 returns the control system 200 to its idle cycle, and the drive mechanism 120 and cylinders 131 and 141 stop at their present location. When activated, unpressurized hydraulic fluid in the return side 137 and 147 of the cylinders 131 and 141 is pushed out and back to the reservoir 23. Once the workpiece 10 is bent to the predetermined desired angular bend angle set by the limit switch 155, electric power is cut to solenoid 231 and pressurized hydraulic fluid is redirected to idle path 225. The bending pedal 235 can then be released and returns to its disengaged position. Before swinging bracket 110 and counter-die 31 are swung to their disengaged position 117 to remove the bent workpiece 15 as in FIG. 10E, the hydraulic drive 120 is backed off or returned slightly, as discussed below, to release any remaining bending forces acting on the workpiece 10.

During the return cycle, the operator steps on return cycle foot pedal 236 to depress it into an engaged position. This activates the solenoid 232 of valve 220 to direct the flow of pressurized fluid to travel along return cycle path 228. The pressurized fluid flow of path 228 divides into two equal pressure return paths 251 and 252. These paths 251 and 252 are fluidly connected via their respective flex hoses 26 to the return sides 137 and 147 of the cylinders 131 and 141, respectively. This flow of pressurized fluid causes the drive rods 135 and 145 to simultaneously retract at the same rate, which simultaneously rotates the bending die 31 and spindle 51 counter clockwise and the counter die 41 and arm 62 clockwise 148, both at the same rate of rotation. The foot pedal 236 must remain depressed during the entire return cycle to keep pressurized hydraulic fluid flowing to the cylinders 131 and 141, until the machine 20 reaches its home position 121 as in FIG. 10D. Again, should the operator remove his or her foot from the pedal 236, the solenoid valve 220 returns the control system 200 to its idle cycle, and the drive mechanism 120 and cylinders 131 and 141 stop at their present location. Similar to the bend cycle, when activated, unpressurized hydraulic fluid in the drive side 136 and 146 of the cylinders 131 and 141 is pushed out and back to the reservoir 23. The drive rods 135 and 145 bottom out against their respective cylinder housing 132 or 142 when the machine 20 returns to its home position 121 at 0° of angular bend.

Bending Process

Although the process of using the inventive bending machine 20 to bend workpieces 10 should be readily understood based on the above description, the following is provided to assist the reader. Once the appropriate set of dies 30 is determined based on the diameter of the workpiece 10 to be bent, the appropriate bending die 31 is selected with the desired bend radius along with the counter-die 41 for that set 30. The counter-die assembly 81 is pulled back along the track 71 to allow the access space to secure the dies 31 and 41. The selected bending die 31 is secured to the spindle 51, and the selected counter-die 41 is secured to the swing bracket 110 of the counter-die assembly 81.

The counter-die 41 is aligned with the bending die 31 to set the die gap between them as shown in FIG. 10A. With the machine 20 preferably in its home position 121, the counter-die assembly 81 is slid radially forward in an uninhibited manner along the track 71 to an incremental position set by one of the teeth 84 of the ratchet mechanism 91 where the flat front end 44 of counter-die 41 is about ⅛ inch from the outer perimeter 32 of the bending die 31. The tip 93 of the ratchet arm 92 engages the trough or lowest point of the tooth 84*a*. The incremental radial alignment of the dies 31 and 41 and setting of the die gap is done by either physically determining the gap between the dies, such as by measurement or viewing, or by moving the assembly 81 to a location marked for the selected dies 31 and 41, such as via a template placed radially along arm 62. The saw-tooth shape of the engaged tooth 84*a* and the bit angle of the spring loaded ratchet allow uninhibited forward sliding movement of the counter-die assembly 81, but prevent rearward movement. The hub 102 of the fine tuning device 101 is rotated to move the ratchet mechanism 91 and counter-die assembly 81 forward or backward a slight amount to decrease or increase the die gap a corresponding amount. The fine tuning device 101 is also used to adjust the die pressure acting on the workpiece 10. The quick release 110 is in its engaged position when aligning the die gap.

Figure 10B:
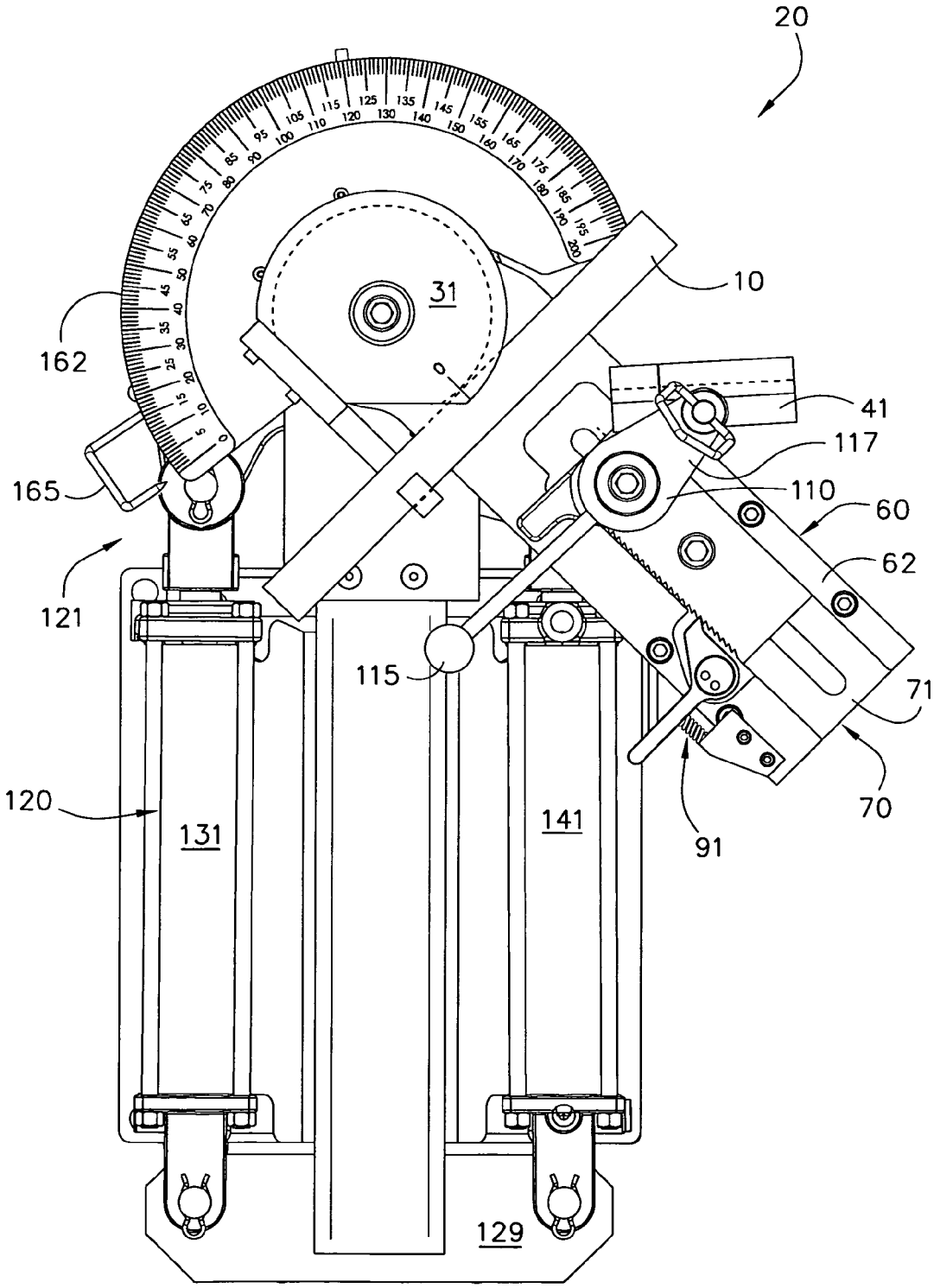
FIG. 10B is a partial top view of the present tube bending machine in its home position with the counter die assembly locked in place at its desired position, and the counter-die assembly swung to the side to allow the insertion of a straight tube to be bent.

The quick release 110 is swung to its disengaged position 117, and the workpiece 10 to be bent is loaded, such as is shown in FIG. 10B. A portion of the workpiece 10 extends through the hook 38 of the bending die 31. The pipe or tube 10 is placed against the groove surface 35 of the bending die 31 so that the workpiece is tangent to the groove 35 at the location where the bend should begin. The quick release 110 is then swung closed so that the workpiece 10 engages the groove surface 45 of the counter-die 41 to grip and hold the workpiece 10 in place as in FIG. 10C. The fine tuning device 101 can also be used at this point to adjust the pressure acting on the workpiece 10. The locking bolts 83 and 86 are tightened to rigidly secure the counter-die assembly 81 to the radial arm 62. At some point, the electro-hydraulic control system 200 is activated via switch 29*a*. When initially activated, the control system 200 is in an idle cycle where hydraulic fluid is taken from the reservoir 23, pressurized by pump 29 and returned to the reservoir without activating the hydraulic drive mechanism 120. Neither foot pedal 235 and 236 is depressed.

The desired bend angle is pre-set by rotating the dial 154 until fixed arrow 158 points to the desired bend angle marked on the upper surface of the protractor-like dial 154 as shown in FIGS. 6 and 10A-C. Once the die gap is properly set, the workpiece 10 is properly aligned and secured to the bending machine 20, and the dial 154 is set to the desired bend angle, the operator initiates or actuates the bending or drive cycle of the dual hydraulic drive mechanism 120 and its electro-hydraulic control system 200 by stepping on and depressing foot pedal 235. The pedal 235 remains depressed during the bend cycle, but can be released at any time to instantly stop the bend cycle if desired.

During the bend or drive cycle, the drive rods 135 and 145 simultaneously extend at substantially the same rate and distance from their home position 121 to the desired position 125 that achieves the desired pre-set bend angle on dial 154 as shown in FIG. 10D. The bending die 31 and counter-die 41 simultaneously rotate in opposite directions 138 and 148, respectively, about axis of rotation 52. The tube or pipe workpiece 10 remains fixed to the hook 38 and bends around the groove 35 of the bending die 31, and is drawn through the groove 45 of the counter die 41, to create the desired bend angle in the bend region 16 of the workpiece 15. After the bend is completely formed, the operator removes his or her foot from the drive pedal 235, and the electro-hydraulic control 200 returns to its idle cycle.

Figure 10C:
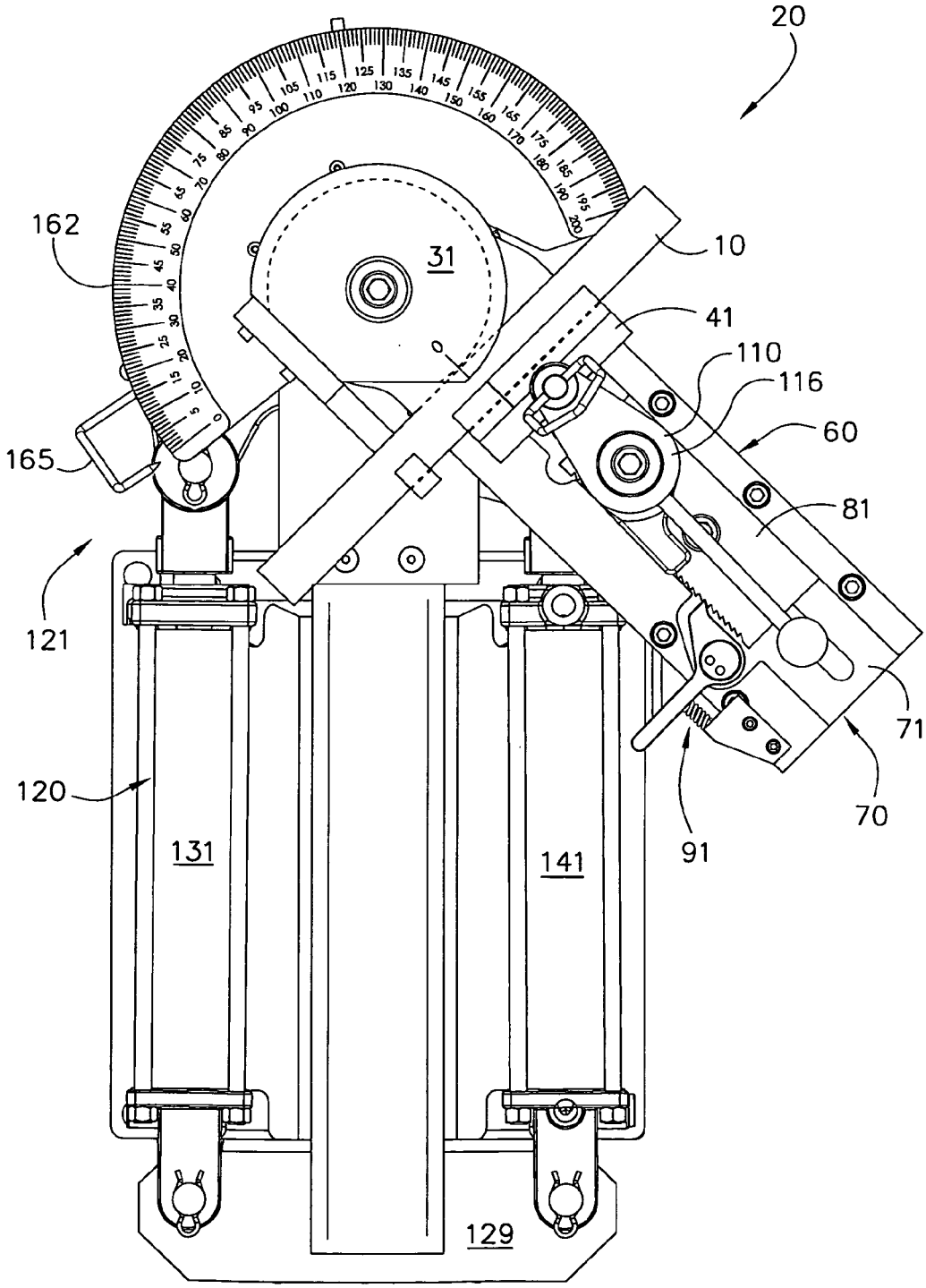
FIG. 10C is a partial top view of the present tube bending machine in its home position with the counter die assembly locked in place at its desired position, and the counter-die assembly swung back to securingly engage the straight tube to be bent.
Figure 10D:
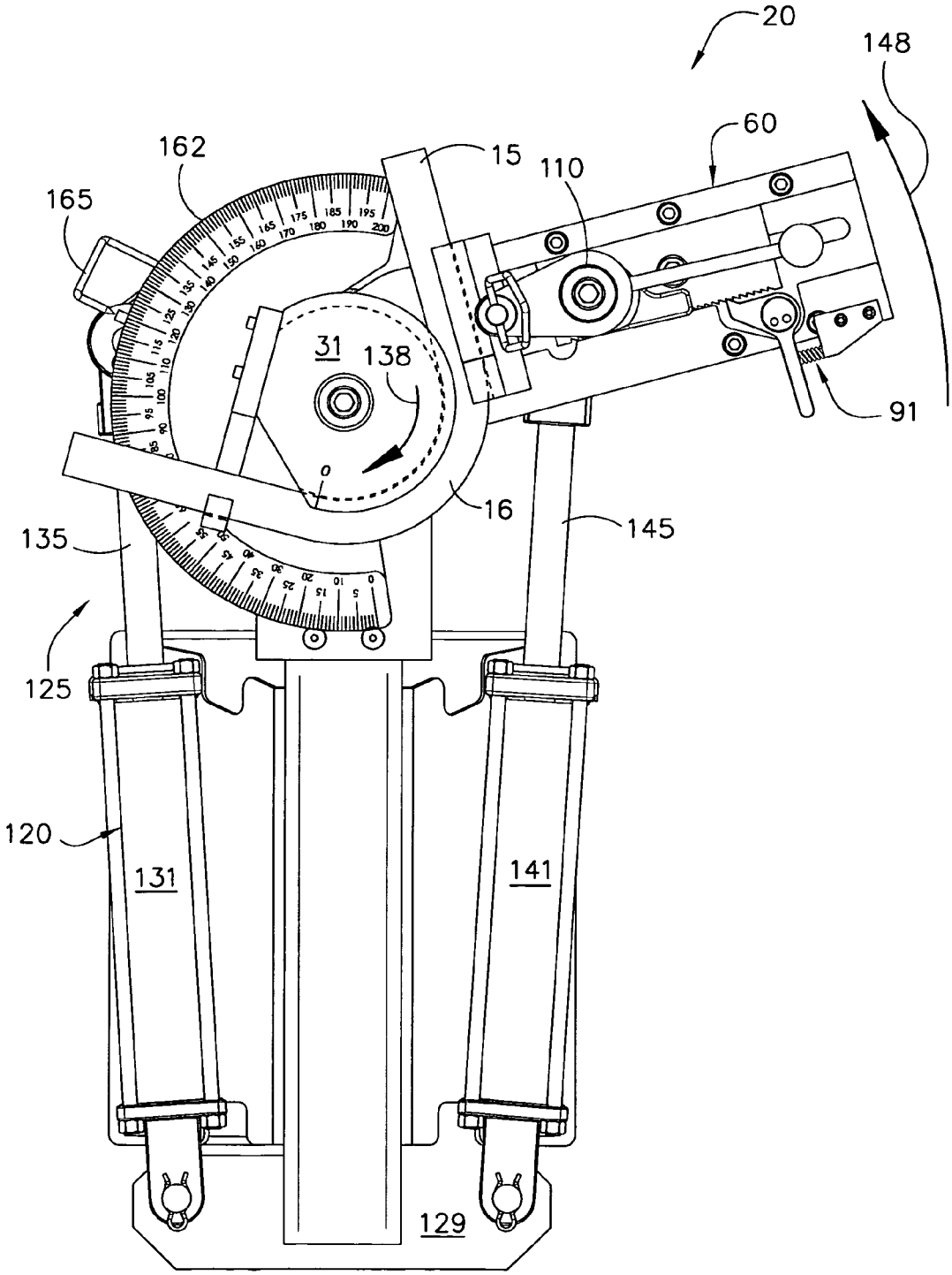
FIG. 10D is a partial top view of the present tube bending machine with the hydraulic drives advancing the spindle and die and the rotating arm and counter-die to a desired stop position to bend the tube to a desired bend angle.
Figure 10E:
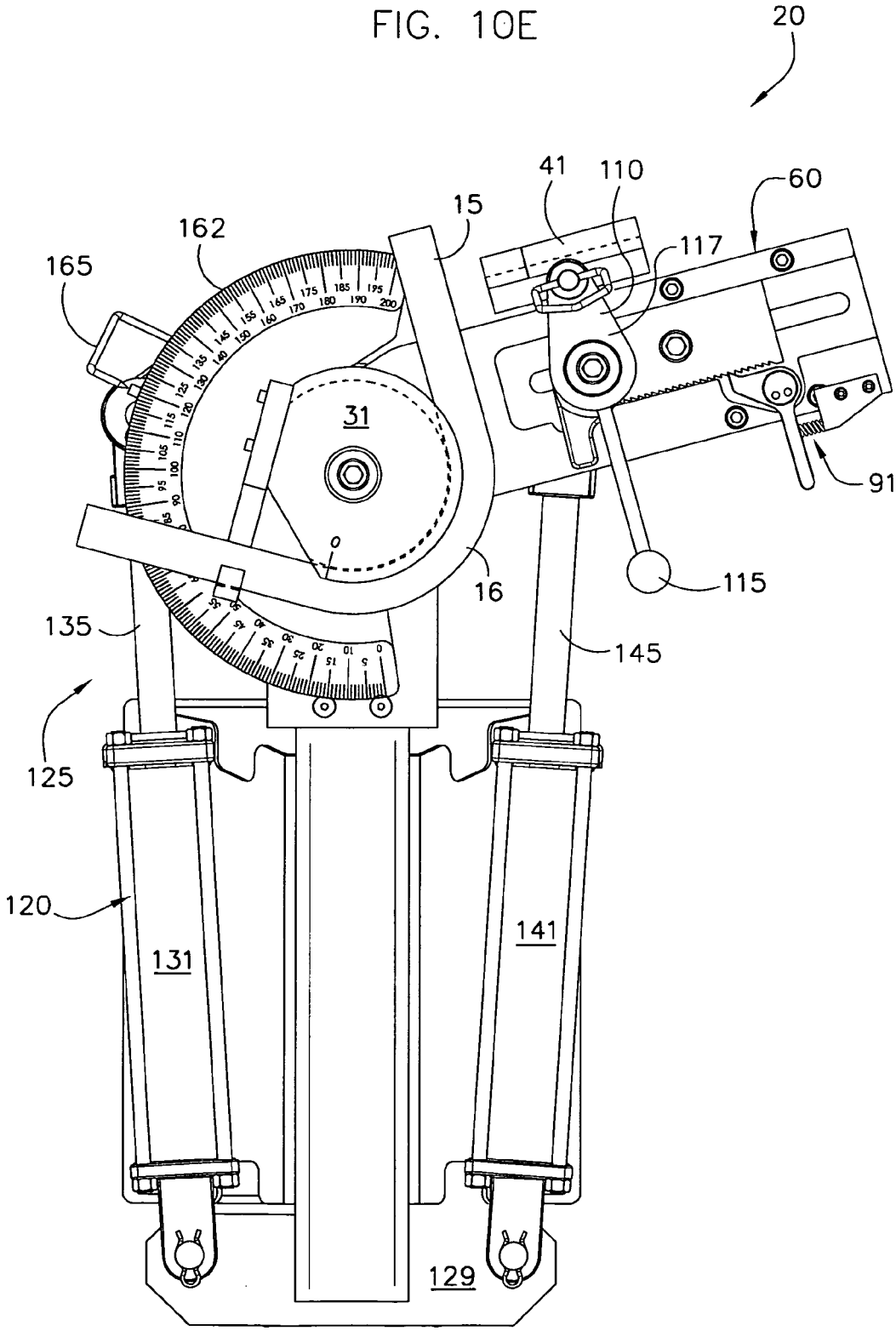
FIG. 10E is a partial top view of the present tube bending machine in its stop position with the counter-die assembly swung to the side to allow the removal of the bent tube.

The bent workpiece 15 is removed from the machine 20 by swinging the quick release 110 to its disengaged position 117 as shown in FIG. 10E. As noted above, the hydraulic drive 120 should be returned slightly to release any remaining bending forces acting on the workpiece 15 before swinging the quick release 110. The bent workpiece 15 should be removed before initiating the return cycle to avoid binding that can damage the machine 20 or the shape of the bend in the workpiece 15.

The machine 20 is returned to its home position 121 by stepping on the return pedal 236 until the drive rods 131 and 141 of the hydraulic drive 120 reach the home position 121 as in FIGS. 10A-C. Again, the pedal 236 remains depressed during the return cycle, but can be released at any time to instantly stop the return cycle. A new tube workpiece 10 with the same diameter can be inserted into the machine 20 as described above, and the bending, removing and returning steps are repeated.

When a different radius bend is desired for a new workpieces 10 with the same diameter, or for a different location of a previous workpiece 15, the counter die 41 is left in place, but a new bending die 31' or 31" must be selected from the die set 30, and placed on the spindle 51. The above process is repeated after readjusting the die gap for the new bending die 31' or 31". The locking bolts 83 and 86 are loosened, and the counter-die assembly 81 is slid radially forward or backward in the alignment track 71. The assembly 81 is slid an incremental distance equal to the change in radius between the new bending die 31' or 31" and old bending die 31 until the tip 93 of the ratchet 91 is resting in the proper tooth 84*a* to set the new die gap. The incremental sliding movement of the assembly 81 is easily achieved because the appropriate sliding movement is equal to a multiple of the unit length of the teeth 84. In other words, the unit length of each ratchet tooth 84*a* is an integer fraction (e.g., 1/1, ½, ⅓, ¼, etc.) of the incremental difference in bend radius between the previous selected 31 and newly selected bending die 31' or 31" for that die set 30. This same principal also applies for other die sets 30*a* made for of the bending machine 20. Thus, even when there is a change in the diameter of the workpiece 10, the incremental adjustment of the die gap is easily achieved by incremental and radial sliding movement of the counter-die assembly 81 along the alignment track 71. Once the counter-die assembly 81 and die gap are properly aligned when the tip 93 of the ratchet 91 rests in the trough of the appropriate tooth 84*a*, then the locking bolts 83 and 86 are tightened, and the bending, removing and returning steps are repeated.

While the invention has been described with reference to a preferred embodiment, it will be understood by those skilled in the art that various changes may be made and equivalents may be substituted without departing from the broader aspects of the invention.

I claim:

1. A rotary draw tube bender for bending tubular workpieces such as a tube or pipe, each workpiece having a uniform outer diameter, said rotary draw tube bender comprising:

at least one die set including a counter die and a plurality of bending dies with different and progressively increasing bend radii, two of said bending dies having an incremental difference in bend radius, said bending dies having a circumferential concave groove and said counter-die having a linear concave groove, said grooves being sized and shaped to substantially flushly engage the workpiece;

a spindle rotatable about an axis of rotation and adapted to securely receive a selected bending die, said spindle and selected bending die rotating in unison;

an arm extending radially from and rotatable about said axis of rotation, said arm having a radial axis that intersects said axis of rotation, said arm having an alignment mechanism with a radial track that slidably receives a counter-die assembly adapted to receive a selected counter-die, said alignment mechanism having ratchet teeth, said track and teeth being substantially parallel to said radial axis, said teeth having a unit length a fraction of said incremental difference in bend radius of said bending dies, said alignment mechanism including a ratchet assembly to incrementally radially align said counter-die with said bending die to accurately set a die gap between them;

a drive mechanism including first and second hydraulic cylinders positioned about a line of symmetry that intersects said axis of rotation, said drive mechanism having a home position, said first hydraulic cylinder having a drive side, a return side and a first drive rod connected to said spindle, said first drive rod being movable between retracted and extended positions to rotate said spindle, and said second hydraulic cylinder having a drive side, a return side and a second drive rod connected to said arm, said second drive rod being movable between retracted and extended positions to rotate said arm in an opposite direction relative to said rotation of said spindle;

a bend angle setting device having a limit switch and a dial with a triggering device, said dial and triggering device being selectively rotatable relative to said limit switch to position said triggering device at a desired bend angle position relative to said limit switch, said limit switch triggering when said triggering device is angularly aligned with said limit switch;

a control unit including a drive cycle control and a return cycle control, each of said controls being selectively movable to an engaged position;

an electro-hydraulic control system having an electrically powered pump and a control valve in electrical communication with said control unit, said control valve having a drive cycle path and a return cycle path, said pump transmitting pressurized hydraulic fluid to said control valve, said control valve directing said pressurized hydraulic fluid to said drive side of said hydraulic cylinders to extend said drive rods when said drive cycle control is engaged, and said control valve directing said pressurized fluid to said return side of said hydraulic cylinders to retract said drive rods when said return cycle control is engaged; and, wherein engaging said drive cycle control simultaneously extends said drive rods at equal rates to rotate said bending die in a first direction and said counter-die in an opposite direction until said limit switch is triggered when a desired angular bend is formed in the workpiece, and wherein moving said return cycle control mechanism to said engaged position simultaneously retracts said drive rods and rotates said bending die and counter-die to return said drive mechanism to its said home position.

2. The rotary draw tube bender of claim 1, and wherein said control valve is a solenoid valve, and said electro-hydraulic control system includes a flow synchronizer that distributes said pressurized fluid to said drive sides of said first and second cylinders at equal pressure.

3. The rotary draw tube bender of claim 2, and wherein said control valve has an idle path and said control valve is biased to transmit said pressurized hydraulic fluid to said idle path when said control system is activated and said controls are in disengaged positions.

4. The rotary draw tube bender of claim 3, and wherein said drive cycle and return cycle controls are foot pedals, each foot pedal being biased into a raise disengaged position and selectively movable to a depressed engaged position.

5. The rotary draw tube bender of claim 4, and wherein said electro-hydraulic control system includes a manifold, said manifold fluidly connecting said control valve to said flow synchronizer, a pressure relief valve and a removable pressure gauge.

6. The rotary draw tube bender of claim 1, and wherein said home position is at a 0° of bend angle position, and said drive rods bottom out against their said cylinder at said home position to stop said retraction of said drive rods and said rotation of said dies.

7. The rotary draw tube bender of claim 6, and wherein said dial has a hemisphere shape with angular markings between 0° and 180° similar to a protractor, and said dial is selectively positionable relative to said limit switch at a desired bend angle position between 0° and 180°.

8. The rotary draw tube bender of claim 7, and wherein said drive mechanism and electro-hydraulic control system maintain said amount of rotation of said spindle equal to said amount of rotation of said counter-die during said bending cycle.

9. The rotary draw tube bender of claim 1, and wherein said counter-die assembly includes a pivot post offset from said axis of rotation to pivotally secure a quick release, said quick release having a rotatable arm with a pin to pivotally and removably secure said counter-die, said quick release being adapted to swing said counter-die to an engaged position aligned with said bending die to slidably hold the workpiece, and to swing said counter-die to a disengaged position out of alignment from said bending die to allow the workpiece to be inserted and removed.

10. The rotary draw tube bender of claim 9, and wherein said ratchet teeth have a saw-tooth configuration and are substantially linearly aligned with said radial axis.

11. The rotary draw tube bender of claim 9, and wherein said ratchet assembly includes a fine tuning device having a rotatable hub, said hub securing said ratchet assembly to said radial arm, said hub being selectively rotatable to advance said ratchet assembly forward or backward.

12. The rotary draw tube bender of claim 11, and wherein said hub has a circular perimeter that rotatably engages a main body of said ratchet mechanism and defines a central axis, said hub having a mounting post rotatably secured to said radial arm about a mounting axis, said central axis and mounting axis being offset, and said offset being equal to about half said unit length of said ratchet teeth, wherein said fine tuning device combines with said ratchet mechanism to provide an infinite range of adjustability for setting said die gap.

13. The rotary draw tube bender of claim 1, and wherein said bending dies are removably secured to said spindle by posts that matingly engage said spindle, and said base of said counter-die assembly snuggly and slidably engaging said radial track.

14. The rotary draw tube bender of claim 1, and wherein said spindle, arm, drive mechanism, bend angle setting device, and electro-hydraulic control system are secured to an integral frame.

15. The rotary draw tube bender of claim 14, and wherein said first drive rod is pivotally connected to said spindle a set radial distance from said axis of rotation and a set angle from said line of symmetry when in said home position, and said second drive rod is pivotally connected to said radial arm an equal radial distance from said axis of rotation and an opposite angle from said line of symmetry when in said home position.

16. A tube bending process for bending tubular workpieces having a uniform outer diameter, said tube bending process comprising the steps of:

providing at least one die set including a counter die and a plurality of bending dies with different and progressively increasing bend radii, two of said bending dies having an incremental difference in bend radius, said bending dies having a circumferential concave groove and said counter-die having a linear concave groove, said grooves being sized and shaped to substantially flushly engage the workpiece;

providing a tube bending machine having a rotatable spindle, a rotatable radial arm, first and second hydraulic cylinders and a bend angle setting device, said radial arm having a radial track that slidably receives a counter-die assembly, said counter-die assembly having a base, quick release and ratchet assembly, said base slidably engaging said track and rotatably holding said quick release, said counter die assembly having ratchet teeth, said ratchet teeth having a unit length a fraction of said incremental difference in bend radius, said ratchet assembly incrementally radially aligning said counter-die assembly, said first hydraulic cylinder selectively rotating said spindle about an axis of rotation from a home position through an angular range of rotation in a first direction; said second hydraulic cylinder selectively rotating said radial arm and counter-die assembly about said axis of rotation from said home position through said angular range of rotation in an opposite direction, said bend angle setting device being adapted to selectively limit said angular range of rotation of said spindle and radial arm;

a. selecting a bending die having a desired bend radius and a corresponding counter die to make a first bend;

b. installing said selected bending die on said spindle, and installing said selected counter-die on said quick release of said counter-die assembly;

c. aligning said selected counter-die a desired distance from said selected bending die by slidably and incrementally moving said base and counter-die assembly along said radial track, said ratchet assembly allowing incremental radial movement to set a proper die gap between said bending die and said counter-die;

d. swinging said selected counter-die to an open position;

e. inserting the workpiece between said selected die and counter-die;

f. swinging said counter die to a closed position to grip the workpiece;

g. locating said bend angle setting device to a desired bend angle;

h. actuating said drive mechanism to simultaneously extend said first and second hydraulic cylinders to rotate said selected bending die in one direction and said selected counter-die in an opposite direction to bend the workpiece to said desired bend angle;

i. swinging said counter die to said open position and removing said workpiece;

j. actuating said drive mechanism to retract said first and second hydraulic cylinders to rotate said selected bending die and counter-die to said home position;

k. selecting a new bending die with a different bend radius from said die set to make a second bend;

l. removing said previously selected bending die from said spindle, and installing said newly selected bending die to said spindle;

m. aligning said previously selected counter-die a desired distance from said newly selected bending die by slidably and incrementally moving said counter-die assembly an incremental amount along said radial track to set a proper die gap between said newly selected bending die and said previously selected counter-die; and, n. repeating steps e through j to make said second bend in the same workpiece.

17. The tube bending process of claim 16, and wherein said counter-die assembly includes a locking mechanism including a locking bolt for selectively securing said base to said radial arm when tightened, and wherein said tube bending process further includes a step of locking said counter-die base to said radial arm by tightening said locking bolt.

18. The tube bending process of claim 16, and wherein each of said teeth is about ⅛ inch in length, and wherein each of said aligning steps sets a die gap of about ⅛ inch.

19. The tube bending process of claim 16, and wherein said ratchet assembly includes a rotatable fine tuning device, and wherein said first aligning step includes rotating said fine tuning device to position said counter-die about ⅛ inch away from said die.

20. A rotary draw tube bender for bending tubular workpieces such as a tube or pipe, each workpiece having a uniform outer diameter, said rotary draw tube bender comprising:

at least one die set including a counter die and a plurality of bending dies with different and progressively increasing bend radii, two of said bending dies having an incremental difference in bend radius, said bending dies having a circumferential concave groove and said counter-die having a linear concave groove, said grooves being sized and shaped to substantially flushly engage the workpiece;

a spindle rotatable about an axis of rotation and adapted to securely receive a selected bending die, said spindle and selected bending die rotating in unison;

an arm extending radially from and rotatable about said axis of rotation, said arm rotating independently of said spindle and having a radial axis that intersects said axis of rotation, said arm having an alignment mechanism with a radial track that slidably receives a counter-die assembly adapted to receive a selected counter-die, said counter-die assembly having ratchet teeth, said track and teeth being substantially parallel to said radial axis, each of said teeth having a unit length that is an integer fraction of said incremental difference in bend radius of said bending dies, said alignment mechanism including a ratchet assembly to incrementally radially align said counter-die with said bending die to accurately set a die gap between them;

a drive mechanism including first and second hydraulic cylinders positioned about a line of symmetry that intersects said axis of rotation, said drive mechanism having a home position, said first hydraulic cylinder having a drive side, a return side and a first drive rod connected to said spindle, said first drive rod being movable between retracted and extended positions to rotate said spindle, and said second hydraulic cylinder having a drive side, a return side and a second drive rod connected to said arm, said second drive rod being movable between retracted and extended positions to rotate said arm in an opposite direction relative to said rotation of said spindle;

a bend angle setting device having a limit switch and a dial with a triggering device, said dial and triggering device being selectively rotatable relative to said limit switch to position said triggering device at a desired bend angle position relative to said limit switch, said limit switch triggering when said triggering device is angularly aligned with said limit switch;

a control unit including a drive cycle control and a return cycle control, each of said controls being selectively movable to an engaged position; and, wherein engaging said drive cycle control simultaneously extends said drive rods at equal rates to rotate said bending die in a first direction and said counter-die in an opposite direction until said limit switch is triggered when a desired angular bend is formed in the workpiece, and wherein moving said return cycle control to said engaged position simultaneously retracts said drive rods and rotates said bending die and counter-die to return said drive mechanism to its said home position.

21. The rotary draw tube bender of claim 20, and wherein said control unit is a pedal control unit, said drive cycle control is a drive cycle pedal and said return cycle control is a return cycle pedal, each of said pedals being biased into a disengaged position;

further including an electro-hydraulic control system having an electrically powered pump and a control valve in electrical communication with said pedal control unit, said control valve being a solenoid valve having a drive cycle path and a return cycle path; and, wherein said electro-hydraulic control system includes a flow synchronizer that distributes a pressurized fluid to said drive sides of said first and second cylinders at equal pressure.

22. The rotary draw tube bender of claim 21, and wherein said drive cycle and return cycle pedals are foot pedals, each foot pedal being biased into a raise disengaged position and selectively movable to a depressed engaged position;

wherein said control valve has an idle path and said control valve is biased to transmit said pressurized hydraulic fluid to said idle path when said control system is activated and said foot pedals are in their said disengaged positions; and, wherein said electro-hydraulic control system includes a manifold, said manifold fluidly connecting said control valve to said flow synchronizer, a pressure relief valve and a removable pressure gauge.

23. The rotary draw tube bender of claim 20, and wherein said home position is at a 0° of bend angle position, and said drive rods bottom out against their said cylinder at said home position to stop said retraction of said drive rods and said rotation of said dies; and, wherein said dial has a hemisphere shape with angular markings between 0° and 180° similar to a protractor, and said dial is selectively positionable relative to said limit switch at a desired bend angle position between 0° and 180°.

24. The rotary draw tube bender of claim 21, and wherein said drive mechanism and electro-hydraulic control system maintain said amount of rotation of said spindle equal to said amount of rotation of said counter-die during said bending cycle.

25. The rotary draw tube bender of claim 20, and wherein said counter-die assembly includes a pivot post offset from said axis of rotation to pivotally secure a quick release, said quick release having a rotatable arm with a pin to pivotally and removably secure said counter-die, said quick release being adapted to swing said counter-die to an engaged position aligned with said bending die to slidably hold the workpiece, and to swing said counter-die to a disengaged position out of alignment from said bending die to allow the workpiece to be inserted and removed.

26. The rotary draw tube bender of claim 20, and wherein said ratchet teeth are substantially linearly aligned with said radial axis; and, wherein said ratchet assembly includes a fine tuning device having a rotatable hub, said hub securing said ratchet assembly to said radial arm, said hub being selectively rotatable to advance said ratchet assembly forward or backward.

27. The rotary draw tube bender of claim 26, and wherein said hub has a circular perimeter that rotatably engages a main body of said ratchet mechanism and defines a central axis, said hub having a mounting post rotatably secured to said radial arm about a mounting axis, said central axis and mounting axis being offset, and said offset being equal to about half said unit length of said ratchet teeth, wherein said fine tuning device combines with said ratchet mechanism to provide an infinite range of adjustability for setting said die gap.

28. The rotary draw tube bender of claim 20, and wherein said bending dies are removably secured to said spindle by posts that matingly engage said spindle, and said base of said counter-die assembly snuggly and slidably engaging said radial track.

29. The rotary draw tube bender of claim 20, and wherein said spindle, arm, drive mechanism, bend angle setting device, and electro-hydraulic control system are secured to an integral frame; and, wherein said first drive rod is pivotally connected to said spindle a set radial distance from said axis of rotation and a set angle from said line of symmetry when in said home position, and said second drive rod is pivotally connected to said radial arm an equal radial distance from said axis of rotation and an opposite angle from said line of symmetry when in said home position.

* * * * *